US011273950B2

(12) United States Patent
Oliveira

(10) Patent No.: US 11,273,950 B2
(45) Date of Patent: Mar. 15, 2022

(54) CARTON WITH LOCKING FEATURES

(71) Applicant: Graphic Packaging International, LLC, Atlanta, GA (US)

(72) Inventor: Steven M. Oliveira, Canton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 28 days.

(21) Appl. No.: 16/036,161

(22) Filed: Jul. 16, 2018

(65) Prior Publication Data

US 2019/0016500 A1 Jan. 17, 2019

Related U.S. Application Data

(60) Provisional application No. 62/533,268, filed on Jul. 17, 2017.

(51) Int. Cl.
*B65D 5/46* (2006.01)
*B65D 21/02* (2006.01)
(Continued)

(52) U.S. Cl.
CPC ..... *B65D 5/46112* (2013.01); *B65D 5/005* (2013.01); *B65D 5/10* (2013.01);
(Continued)

(58) Field of Classification Search
CPC B65D 5/46112; B65D 5/005; B65D 21/0219; B65D 21/0226; B65D 21/064;
(Continued)

(56) References Cited

U.S. PATENT DOCUMENTS

D115,651 S 7/1939 Ford et al.
D120,673 S 5/1940 Jung
(Continued)

FOREIGN PATENT DOCUMENTS

CN 201 284 043 Y 8/2009
CN 201284043 Y * 8/2009
(Continued)

OTHER PUBLICATIONS

International Search Report and Written Opinion for PCT/US2018/042246 dated Nov. 29, 2018.
(Continued)

*Primary Examiner* — Nathan J Newhouse
*Assistant Examiner* — Phillip D Schmidt
(74) *Attorney, Agent, or Firm* — Womble Bond Dickinson (US) LLP

(57) ABSTRACT

A carton for holding one or more articles includes a plurality of panels extending at least partially around an interior of the carton, the plurality of panels including a front panel, a back panel, and at least one side panel. The carton also includes a plurality of end flaps foldably connected to respective panels of the plurality of panels and forming a closed top portion of the carton, the closed top portion of the carton is reconfigurable between a first configuration having a substantially flat profile and a second configuration forming a handle of the carton. The carton also includes locking features for engaging at least one other carton.

53 Claims, 23 Drawing Sheets

(51) Int. Cl.

| | |
|---|---|
| ***B65D 5/10*** | (2006.01) |
| ***B65D 5/00*** | (2006.01) |
| ***B65D 21/06*** | (2006.01) |
| ***B65D 5/20*** | (2006.01) |

(52) U.S. Cl.
CPC ..... *B65D 5/2057* (2013.01); *B65D 21/0219* (2013.01); *B65D 21/064* (2013.01)

(58) Field of Classification Search
CPC ... B65D 5/001; B65D 5/0055; B65D 5/46114
USPC ..... 229/117.14, 117.13, 915; 206/509–510
See application file for complete search history.

(56) References Cited

U.S. PATENT DOCUMENTS

| | | | | |
|---|---|---|---|---|
| 2,348,378 | A | 5/1944 | Goodyear | |
| 2,586,301 | A | 2/1952 | Castle | |
| 3,013,710 | A | 12/1961 | Kronson et al. | |
| 3,150,769 | A | 9/1964 | Cohn | |
| 3,257,027 | A | 6/1966 | Weiss | |
| 3,640,380 | A | 2/1972 | Huffman | |
| D242,901 | S | 1/1977 | Lohrbach | |
| 4,007,869 | A | 2/1977 | Stolkin et al. | |
| 4,185,765 | A | 1/1980 | McLaren | |
| 4,230,261 | A | 10/1980 | Austin | |
| 4,397,393 | A | 8/1983 | Pergande et al. | |
| 4,471,094 | A | 9/1984 | Cassidy | |
| 4,498,585 | A | 2/1985 | Gordon et al. | |
| 4,530,459 | A | 7/1985 | Maroszek | |
| 4,535,928 | A | 8/1985 | Capo | |
| 4,548,352 | A | 10/1985 | Capo et al. | |
| 4,580,718 | A | 4/1986 | Muise | |
| 4,601,390 | A | 7/1986 | Rosenthal et al. | |
| 4,721,243 | A | 1/1988 | Mercurio | |
| 4,782,788 | A | 11/1988 | Arcand | |
| 4,969,596 | A | 11/1990 | Schulbaum | |
| 5,020,337 | A | 6/1991 | Krieg | |
| D319,388 | S | 8/1991 | McIntosh, Jr. et al. | |
| 5,042,715 | A | 8/1991 | McNeill | |
| 5,060,850 | A | 10/1991 | Weaver | |
| 5,240,174 | A | 8/1993 | Wenninger | |
| 5,275,331 | A | 1/1994 | Chung-Piao | |
| 5,299,734 | A | 4/1994 | Lane | |
| 5,392,984 | A | 2/1995 | Yocum | |
| 5,400,901 | A | 3/1995 | Harrelson | |
| 5,413,273 | A | 5/1995 | Money | |
| 5,423,478 | A | 6/1995 | Roosa | |
| 5,458,270 | A | 10/1995 | Tsao | |
| 5,520,284 | A * | 5/1996 | Gray | B65D 5/001 206/509 |
| 5,524,814 | A | 6/1996 | Davis | |
| D371,965 | S | 7/1996 | Kinni | |
| D373,079 | S | 8/1996 | Fahlen | |
| 5,551,556 | A | 9/1996 | Sutherland | |
| 5,595,291 | A | 1/1997 | Negelen | |
| 5,620,134 | A | 4/1997 | Gulliver | |
| D386,680 | S | 11/1997 | Johnson | |
| 5,685,478 | A | 11/1997 | Tang | |
| D396,805 | S | 8/1998 | Broyles | |
| 5,853,121 | A | 12/1998 | Francisco | |
| 5,927,593 | A | 7/1999 | Berkowitz et al. | |
| D418,751 | S | 1/2000 | Wolf | |
| 6,036,085 | A | 3/2000 | Tsao | |
| 6,108,982 | A | 8/2000 | Davison | |
| 6,116,421 | A | 9/2000 | Collins | |
| 6,189,687 | B1 | 2/2001 | Bakx | |
| 6,189,776 | B1 | 2/2001 | Smith et al. | |
| D442,859 | S * | 5/2001 | Hirschey | D9/418 |
| 6,290,123 | B1 | 9/2001 | Pei | |
| 6,439,452 | B1 | 8/2002 | Tsao | |
| D464,878 | S | 10/2002 | Thompson | |
| 6,530,516 | B1 | 3/2003 | Ritter | |
| 6,581,823 | B1 | 6/2003 | De Beck | |
| D488,062 | S | 4/2004 | Shannon | |
| D497,309 | S | 10/2004 | Nordland | |
| 6,837,420 | B2 | 1/2005 | Westerman et al. | |
| D525,866 | S | 8/2006 | Goodwin | |
| 7,328,814 | B2 | 2/2008 | Nordland | |
| D567,671 | S | 4/2008 | Say Ulin | |
| D576,482 | S | 9/2008 | DeBusk | |
| 7,617,969 | B2 | 11/2009 | Oliveira | |
| D640,128 | S * | 6/2011 | Harshman | D9/418 |
| D674,690 | S | 1/2013 | Sill | |
| D675,520 | S | 2/2013 | Sill | |
| D679,178 | S | 4/2013 | Villiers | |
| D693,216 | S | 11/2013 | Sill | |
| D693,677 | S * | 11/2013 | Pearson | D9/431 |
| D758,184 | S | 6/2016 | Tu | |
| D760,446 | S | 6/2016 | Katers | |
| D798,142 | S | 9/2017 | Falcon | |
| 2001/0004088 | A1* | 6/2001 | Lau | B65D 5/2033 229/117.15 |
| 2002/0070268 | A1 | 6/2002 | Schultz | |
| 2003/0111521 | A1 | 6/2003 | Holmes | |
| 2003/0213705 | A1 | 11/2003 | Woog | |
| 2004/0031842 | A1* | 2/2004 | Westerman | B65D 5/2057 229/117.06 |
| 2005/0023331 | A1* | 2/2005 | Hirschey | B65D 5/46112 229/117.15 |
| 2006/0091190 | A1 | 5/2006 | Nikolai | |
| 2007/0000980 | A1 | 1/2007 | Nashua | |
| 2011/0272458 | A1* | 11/2011 | Hardy | B65D 5/48016 229/120.17 |
| 2014/0262911 | A1* | 9/2014 | Kooc | B65D 5/001 206/509 |
| 2016/0039559 | A1* | 2/2016 | Williams | B65D 5/001 229/151 |
| 2016/0052222 | A1* | 2/2016 | Kinney | B65D 5/2057 229/126 |

FOREIGN PATENT DOCUMENTS

| | | | |
|---|---|---|---|
| DE | 3641485 | A1 | 6/1998 |
| EP | 0 053 568 | A1 | 6/1982 |
| EP | 0 611 702 | A1 | 8/1994 |
| EP | 0 639 504 | A1 | 2/1995 |
| GB | 889718 | | 2/1962 |
| JP | H10 157726 | A | 6/1998 |
| JP | 2012 166813 | A | 9/2012 |
| KR | 3020100001674 | | 11/2010 |
| NL | 7 805 903 | A | 12/1979 |
| SE | 140 388 | | 5/1953 |

OTHER PUBLICATIONS

Steeman, Anton, "Innovations in Food Take-Out Packaging," https://bestinpackaging.com/2012/03/13/innovations-in-food-take-out-packaging/, Mar. 13, 2012, 12 pages.

Bakery Food Box Mock-Up, Online, published date unknown. Retrieved on Sep. 5, 2018 from url: https://creativemarket.com/Joiaco/917577-Takeaway-Party-Food-Box.

Supplementary European Search Report for EP 18 83 5444 dated Jan. 20, 2021.

* cited by examiner

CARTON WITH LOCKING FEATURES

CROSS-REFERENCE TO RELATED APPLICATION

This application claims the benefit of U.S. Provisional Patent Application No. 62/533,268, filed on Jul. 17, 2017.

INCORPORATION BY REFERENCE

The disclosure of U.S. Provisional Patent Application No. 62/533,268, filed on Jul. 17, 2017, is hereby incorporated by reference for all purposes as if presented herein in its entirety.

BACKGROUND OF THE DISCLOSURE

The present disclosure generally relates to cartons with a carton for holding one or more articles therein. In particular, the present disclosure is directed to a carton that is provided with a reconfigurable top portion and locking features for engaging at least one other carton.

SUMMARY OF THE DISCLOSURE

According to one aspect of the disclosure, a carton for holding one or more articles comprises a plurality of panels extending at least partially around an interior of the carton, the plurality of panels comprising a front panel, a back panel, and at least one side panel. The carton further comprises a plurality of end flaps foldably connected to respective panels of the plurality of panels and forming a closed top portion of the carton, the closed top portion of the carton is reconfigurable between a first configuration having a substantially flat profile and a second configuration forming a handle of the carton. The carton further comprises locking features for engaging at least one other carton.

According to another aspect of the disclosure, a blank for forming a carton for holding one or more articles comprises a plurality of panels for extending at least partially around an interior of the carton formed from the blank, the plurality of panels comprising a front panel, a back panel, and at least one side panel. The blank further comprises a plurality of end flaps foldably connected to respective panels of the plurality of panels, the plurality of end flaps is for forming a closed top portion of the carton that is reconfigurable between a first configuration having a substantially flat profile and a second configuration forming a handle of the carton formed from the blank. The blank further comprises locking features for engaging at least one other carton when the carton is formed from the blank.

According to another aspect of the disclosure, a method of forming a carton for holding one or more articles, the method comprises obtaining a blank comprising a plurality of panels comprising a front panel, a back panel, and at least one side panel, the blank further comprising a plurality of end flaps foldably connected to respective panels of the plurality of panels, and the blank further comprising locking features for engaging at least one other carton. The method further comprises folding the plurality of panels at least partially around an interior of the carton, folding the plurality of end flaps to form a closed top portion. The closed top portion of the carton is reconfigurable between a first configuration having a substantially flat profile and a second configuration forming a handle of the carton.

According to another aspect of the disclosure, a system comprises a first carton for holding one or more articles, the first carton comprising a plurality of panels extending at least partially around an interior of the first carton, the plurality of panels comprising a front panel, a back panel, and at least one side panel. The first carton further comprises a plurality of end flaps foldably connected to respective panels of the plurality of panels and forming a closed top portion of the first carton, the closed top portion of the first carton has a substantially flat profile and defines a receiving space. The system further comprises a second carton for holding one or more articles, the second carton positioned in the receiving space of the first carton and secured to the first carton, the second carton comprising a plurality of panels extending at least partially around an interior of the second carton, the plurality of panels comprising a front panel, a back panel, and at least one side panel. The second carton further comprises a plurality of end flaps foldably connected to respective panels of the plurality of panels and forming a closed top portion of the second carton, the closed top portion of the second carton forms a handle of the second carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts may be designated by corresponding reference numbers throughout the drawings.

DETAILED DESCRIPTION OF THE EXEMPLARY EMBODIMENTS

Cartons or packages according to the present disclosure can accommodate articles of numerous different shapes. For the purpose of illustration and not for the purpose of limiting the scope of the disclosure, the following detailed description describes articles such as food products at least partially disposed within the carton embodiments. In this specification, the terms "lower," "bottom," "upper", "top", "front", and "back" indicate orientations determined in relation to fully erected cartons.

As described herein, cartons can be formed by multiple overlapping panels and/or end flaps. Such panels and/or end flaps can be designated in relative terms to one another, e.g., "first", "second", "third", etc., in sequential or non-sequential reference without departing from the disclosure.

Figure 1:
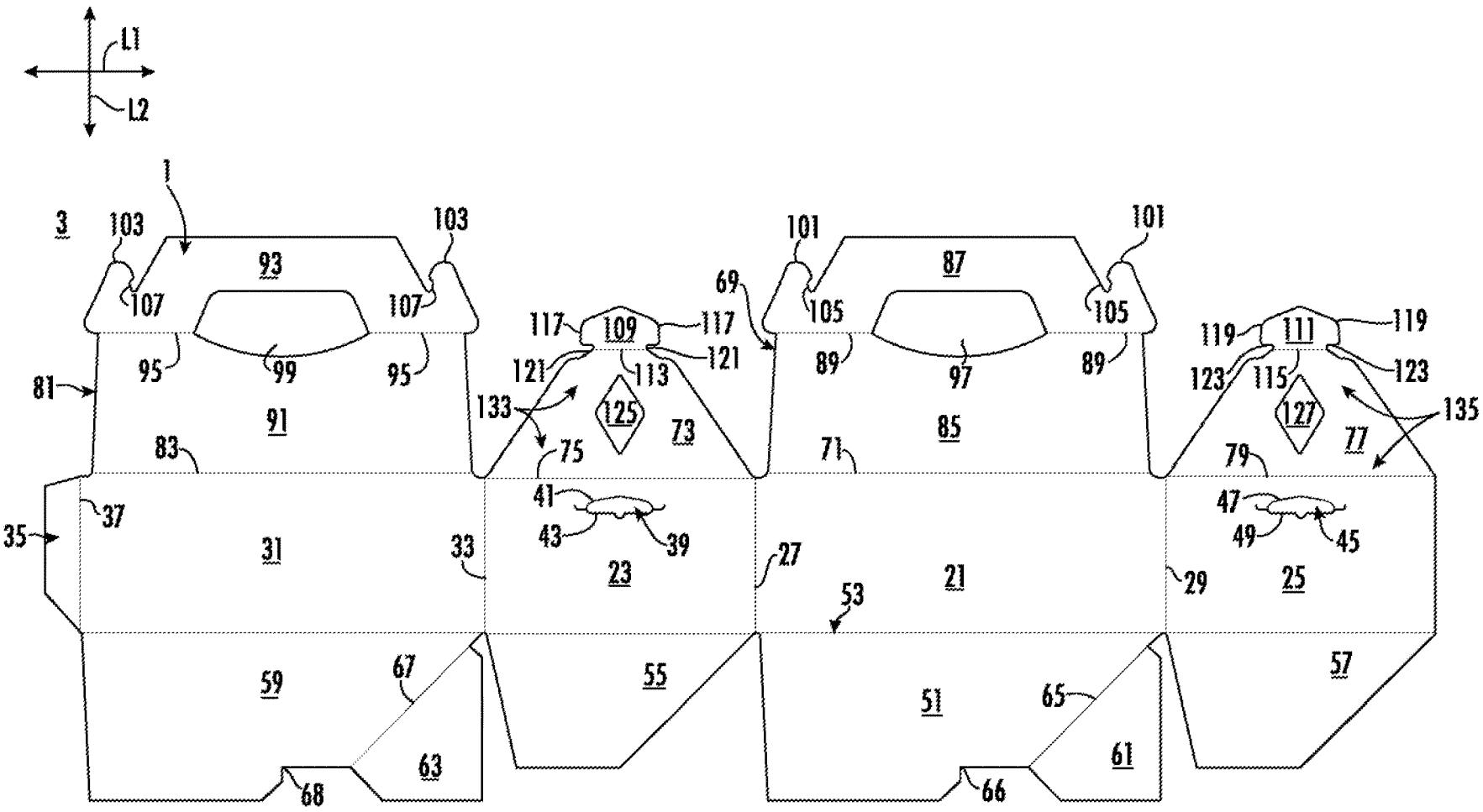
FIG. 1 is a plan view of a blank for forming a carton according to a first exemplary embodiment of the disclosure.

FIG. 1 is a plan view of the exterior side 1 of a blank, generally indicated at 3, that can be obtained and used to form a carton 5 (FIG. 4) according to a first exemplary embodiment of the disclosure. As described herein, the carton 5 can engage and be secured to at least one other carton 5 via locking features 133, 135 to form a carton system or system 137 (FIG. 9) of stacked cartons 5.

As shown, in FIG. 1, the blank 3 has a longitudinal axis L1 and a lateral axis L2. The blank 3 comprises a front panel 21 foldably connected to a first side panel 23 and a second side panel 25 at respective lateral fold lines 27, 29. A back panel 31 is foldably connected to the first side panel 23 at a lateral fold line 33, and an attachment flap 35 is foldably connected to the back panel 31 at a lateral fold line 37. As illustrated in FIG. 1, a locking flap 39 (broadly, "first locking flap") is foldably connected to the first side panel 23 at a fold line 41 and is separable from the first side panel 23 along a line of weakening 43. Similarly, a locking flap 45 (broadly, "second locking flap") is foldably connected to the second side panel 25 at a fold line 47 and is separable from the second side panel 25 along a line of weakening 49. The lines of weakening 43, 49 can extend past the respective locking flaps 39, 45 to form relief tears or relief features in the respective side panels 23, 25.

In the exemplary embodiment shown in FIG. 1, a first bottom end flap 51 is foldably connected to the front panel 21 at a portion of a longitudinal fold line 53, a second bottom end flap 55 is foldably connected to the first side panel 23 at a portion of the longitudinal fold line 53, a third bottom end flap 57 is foldably connected to the second side panel 25 at a portion of the longitudinal fold line 53, and a fourth bottom end flap 59 is foldably connected to the back panel 31 at a portion of the longitudinal fold line 53. As shown, marginal tabs 61, 63 are foldably connected to the respective bottom end flaps 51, 59 at respective oblique fold lines 65, 67. As also shown, respective notches 66, 68 are formed along the respective bottom end flaps 51, 59, and can facilitate formation of the carton 5 (FIG. 4), as described further herein.

Still referring to FIG. 1, a first top end flap 69 is foldably connected to the front panel 21 at a longitudinal fold line 71, a second top end flap 73 (broadly, "first top end flap" or "third top end flap") is foldably connected to the first side panel 23 at a longitudinal fold line 75, a third top end flap 77 (broadly, "second top end flap" or "fourth top end flap") is foldably connected to the second side panel 25 at a longitudinal fold line 79, and a fourth top end flap 81 (broadly, "second top end flap") is foldably connected to the back panel 31 at a longitudinal fold line 83.

As shown, the first top end flap 69 includes a base portion 85 that is foldably connected to the front panel 21 at the fold line 71 and that is foldably connected to a handle portion 87 at a longitudinal fold line 89. Similarly, the fourth top end flap 81 includes a base portion 91 that is foldably connected to the back panel 31 at the longitudinal fold line 83 and includes a handle portion 93 that is foldably connected to the base portion 91 at a longitudinal fold line 95. As shown, the top end flap 69 includes a handle opening 97 in portions of the base portion 85 and the handle portion 87 and which interrupts the fold line 89. Similarly, the top end flap 81 includes a handle opening 99 in portions of the base portion 91 and the handle portion 93 and which interrupts the fold line 95. As also shown, the handle portions 87, 93 of the respective top end flaps 69, 81 each include a respective pair of handle tabs 101, 103 at least partially defined by respective notches 105, 107.

Figure 9:
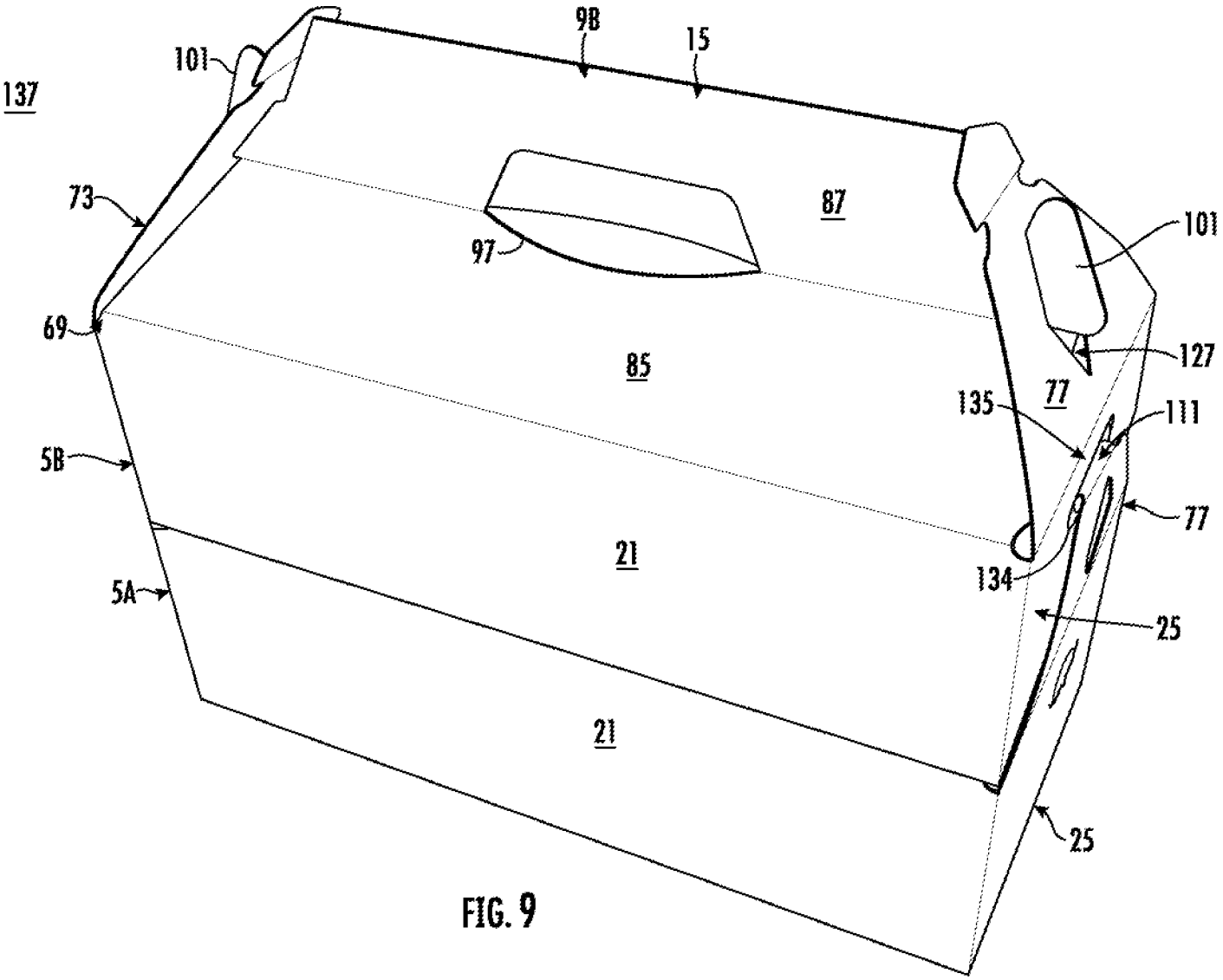
FIG. 9 is a perspective view of a system including the cartons of FIGS. 4 and 5 according to the first exemplary embodiment of the disclosure.

Still referring to FIG. 1, a respective locking tab 109, 111 (broadly, "first locking tab" and "second locking tab", respectively) is foldably connected to the respective top end flaps 73, 77 at respective longitudinal fold lines 113, 115. The locking tabs 109, 111 each have respective flange portions 117, 119 that extend laterally away from the respective fold lines 113, 115 such that a respective pair of engagement notches 121, 123 are formed between the respective locking tabs 109, 111 and the remainder of the respective top end flaps 73, 77. Each top end flap 73, 77 also includes a respective aperture 125, 127, as shown. As described further herein, the locking tabs 109, 111 of a carton 5 can be inserted into respective openings 134 between the respective locking flaps 39, 45 and the respective side panels 23, 25 of another carton 5 to secure multiple cartons 5 to each other in a system 137 (FIG. 9). In this regard, the locking tabs 109, 111 and the respective locking flaps 39, 45 and associated features form respective locking features 133, 135 of the carton 5.

It will be understood that the panels 21, 23, 25, 31, the flaps 35, 51, 55, 57, 59, 69, 73, 77, 81, and/or other portions of the blank 3 may be otherwise shaped or configured without departing from the disclosure.

Figure 2:
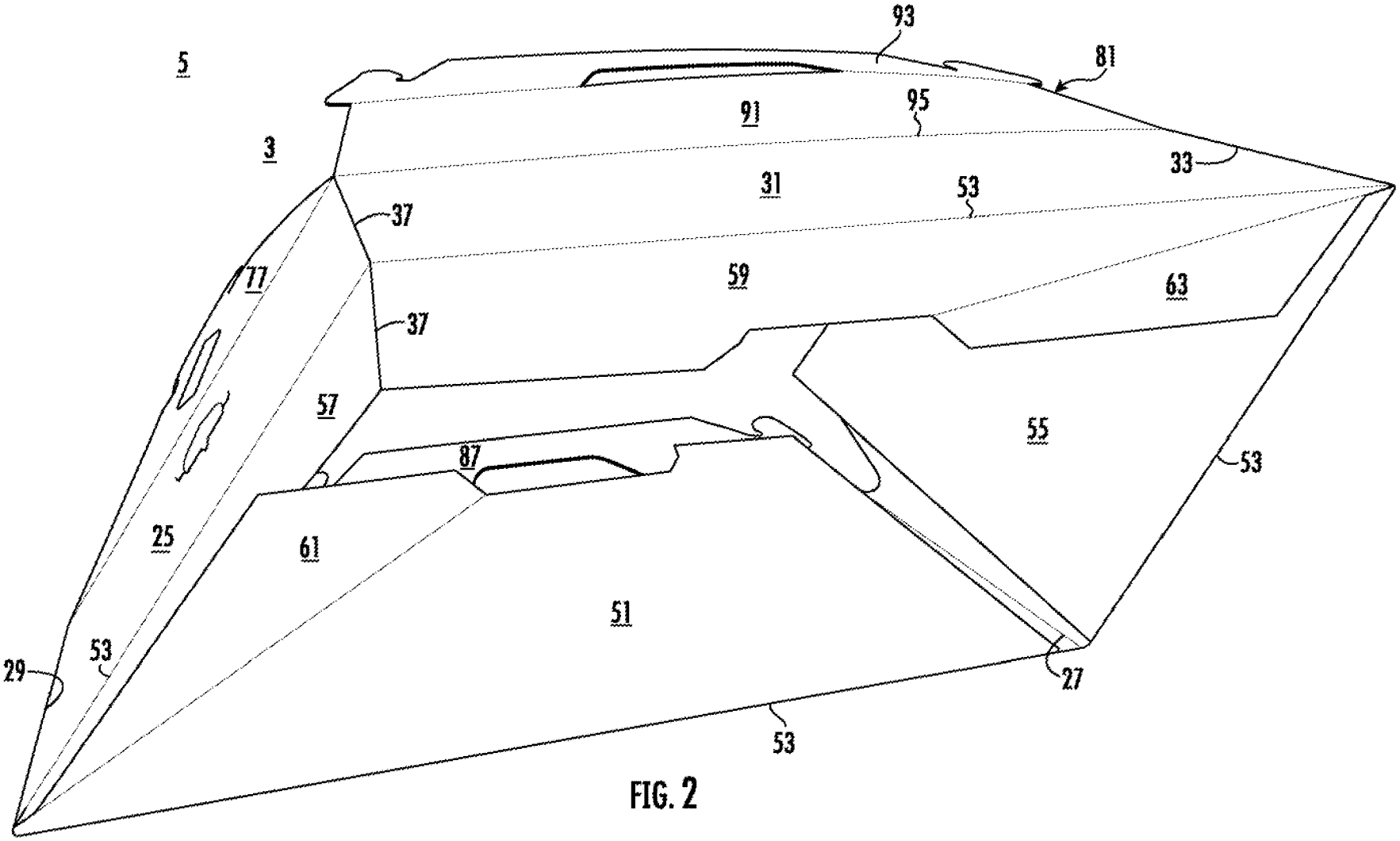
FIG. 2 is a perspective view of a partial assembly of the blank of FIG. 1.
Figure 3:
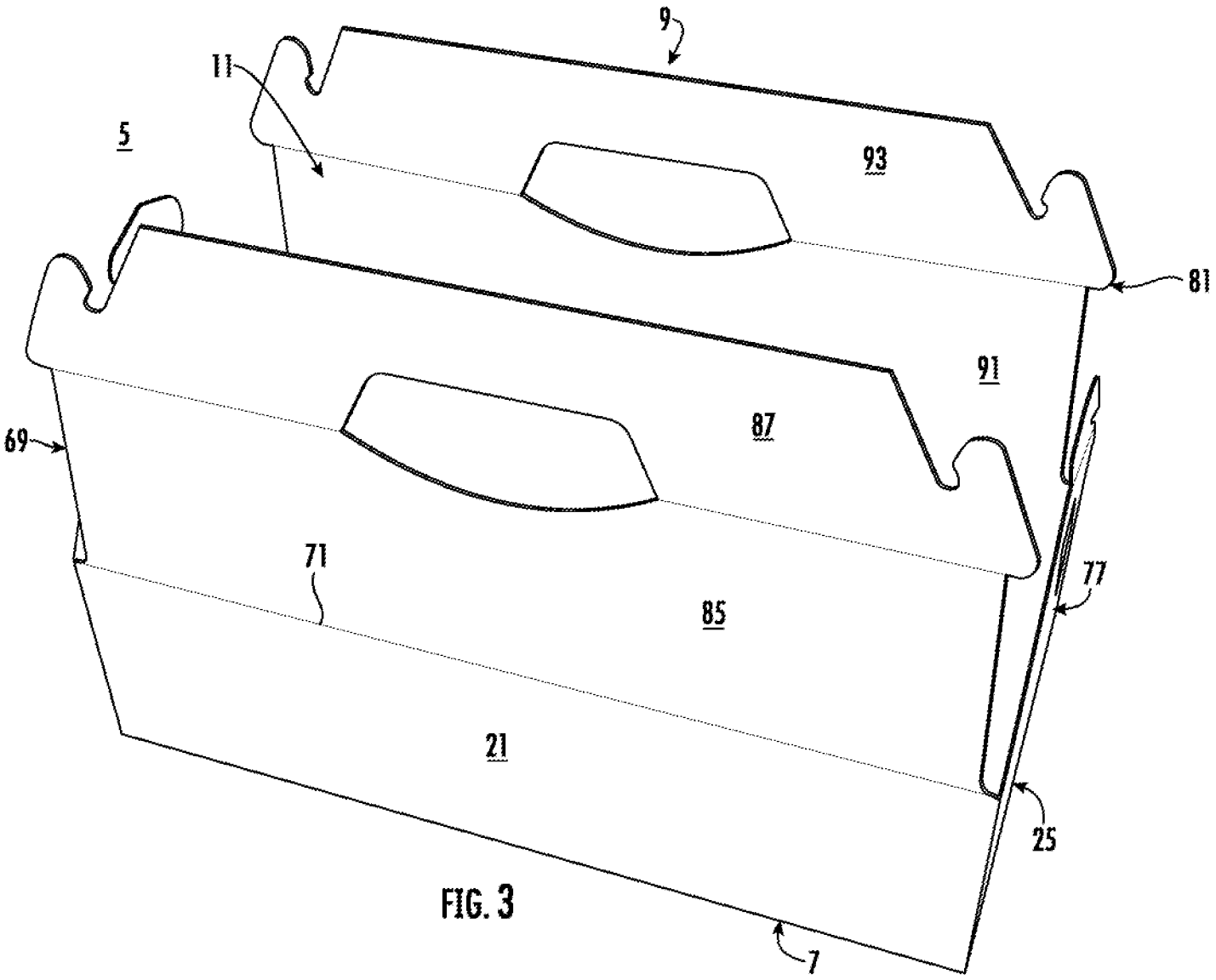
FIG. 3 is a perspective view of a carton formed from the blank of FIG. 1 in an open configuration according to the first exemplary embodiment of the disclosure.

Still referring to FIG. 1, and referring additionally to FIGS. 2 and 3, erection of the carton 5 (FIG. 4) from the blank 3 according to one exemplary embodiment of the disclosure will be described. As shown, the attachment flap 35 can be positioned into at least partial face-to-face contact with the second side panel 25, for example, via folding of the first side panel 23 at the fold line 27, and can be secured thereto with an adhesive such as glue. The front panel 21, the first side panel 23, the second side panel 25, the back panel 31, and the attachment flap 35 can be folded at fold lines 27, 29, 33, 37 such that the front and back panels 21, 31 are substantially parallel to one another and the side panel 23 is substantially parallel to the second side panel 25 and the attachment flap 35. The end flaps 51, 55, 57, 59 can be folded at respective portions of the fold line 53 in overlapping relation to form a closed bottom 7 of the carton 5. In one embodiment, the marginal tabs 61, 63 can be provided with adhesive and in at least partial face-to-face contact with the respective bottom end flaps 57, 55, and the notches 66, 68 of the respective bottom end flaps 51, 59 can interengage one another. In such an arrangement, the marginal tabs 61, 63 can provide connectivity among the end flaps 51, 55, 57, 59 such that the bottom 7 is flexibly reconfigurable between a flattened arrangement and the upwardly-folded arrangement illustrated in FIG. 3. In the configuration of FIG. 3, a top portion 9 of the carton 5 is shown in an open configuration in which the interior 11 of the carton 5 is accessible, for example to load the carton 5 with one or more articles, for example, one or more food products that can be provided, for example, in an unwrapped configuration or wrapped in a secondary packaging, or to retrieve one or more articles from the carton 5.

Figure 4:
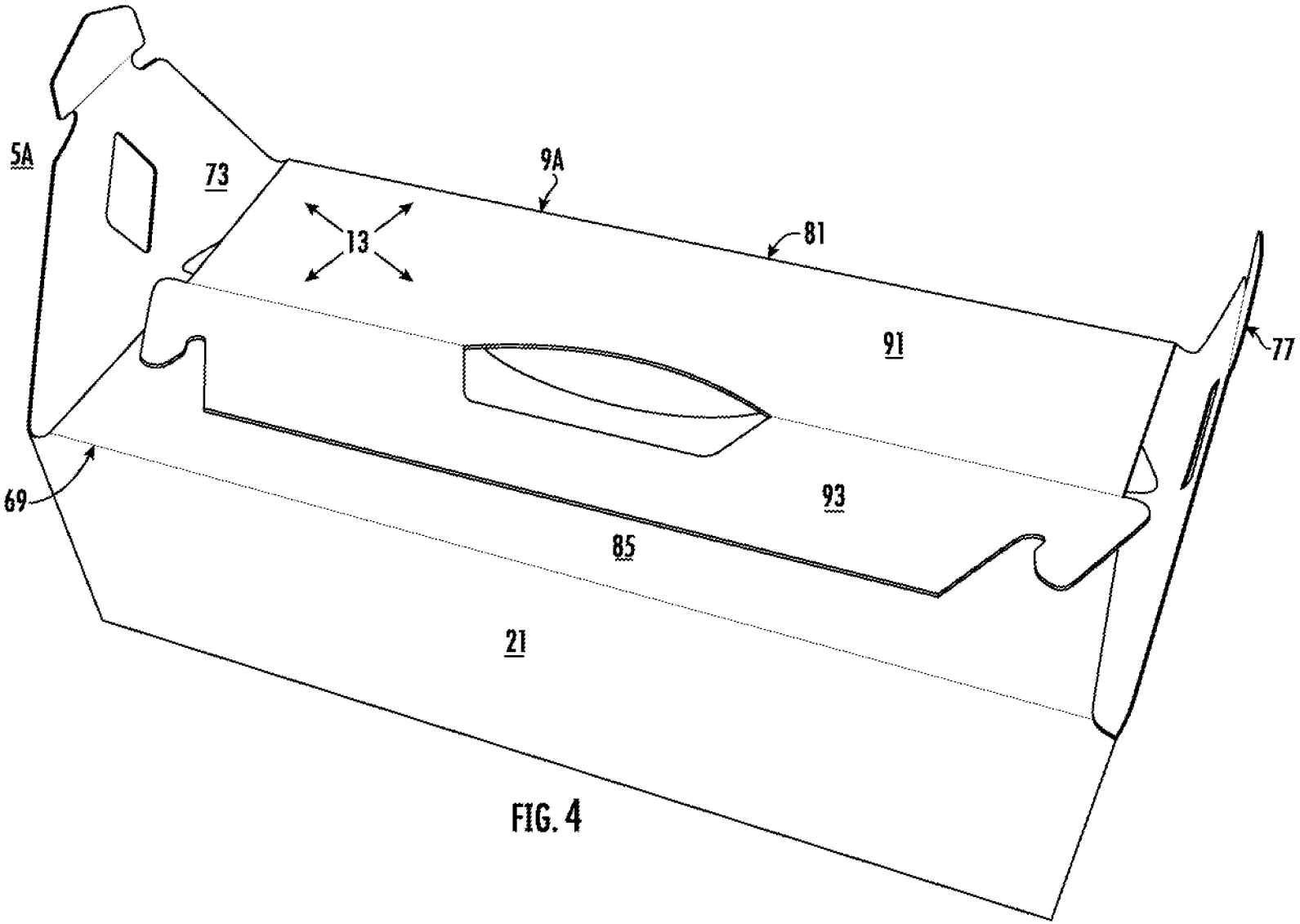
FIG. 4 is a perspective view of the carton of FIG. 3 in a first closed configuration.
Figure 6:
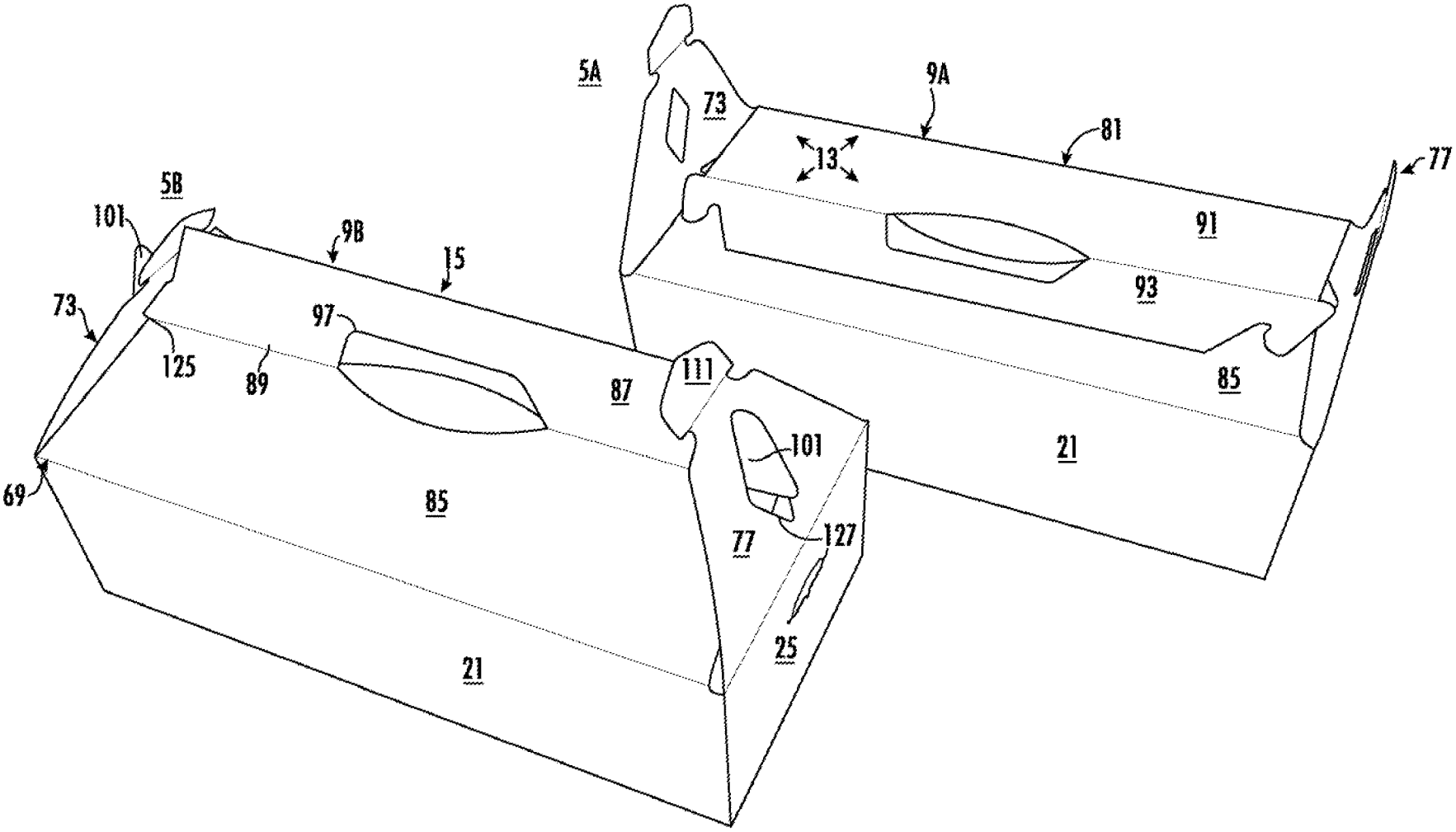
FIG. 6 is a perspective view of the cartons of FIGS. 4 and 5.

Turning additionally to FIG. 4, in a first closed configuration of the carton 5, generally designated 5A, the top end flaps 69, 81 can be folded at the respective fold lines 71, 83 toward the interior 11 of the carton 5 and disposed in overlapping, e.g., generally planar, relation such that a closed top portion 9A of the carton 5A (broadly, "first carton") formed by the top end flaps 69, 81 has a first closed configuration with a substantially flat or low profile configuration, as shown. It will be understood that the carton 5A and the closed top portion 9A will be described herein as one reconfigurable configuration of the carton 5 and top portion 9, and that these terms can be used interchangeably. As shown in FIG. 6, the top end flaps 73, 77 of the carton 5A are maintained in a generally upright position relative to the remainder of the carton 5A such that a receiving space 13 for one or more other cartons is defined on the closed top portion 9A between the top end flaps 73, 77, as described further herein.

Figure 5:
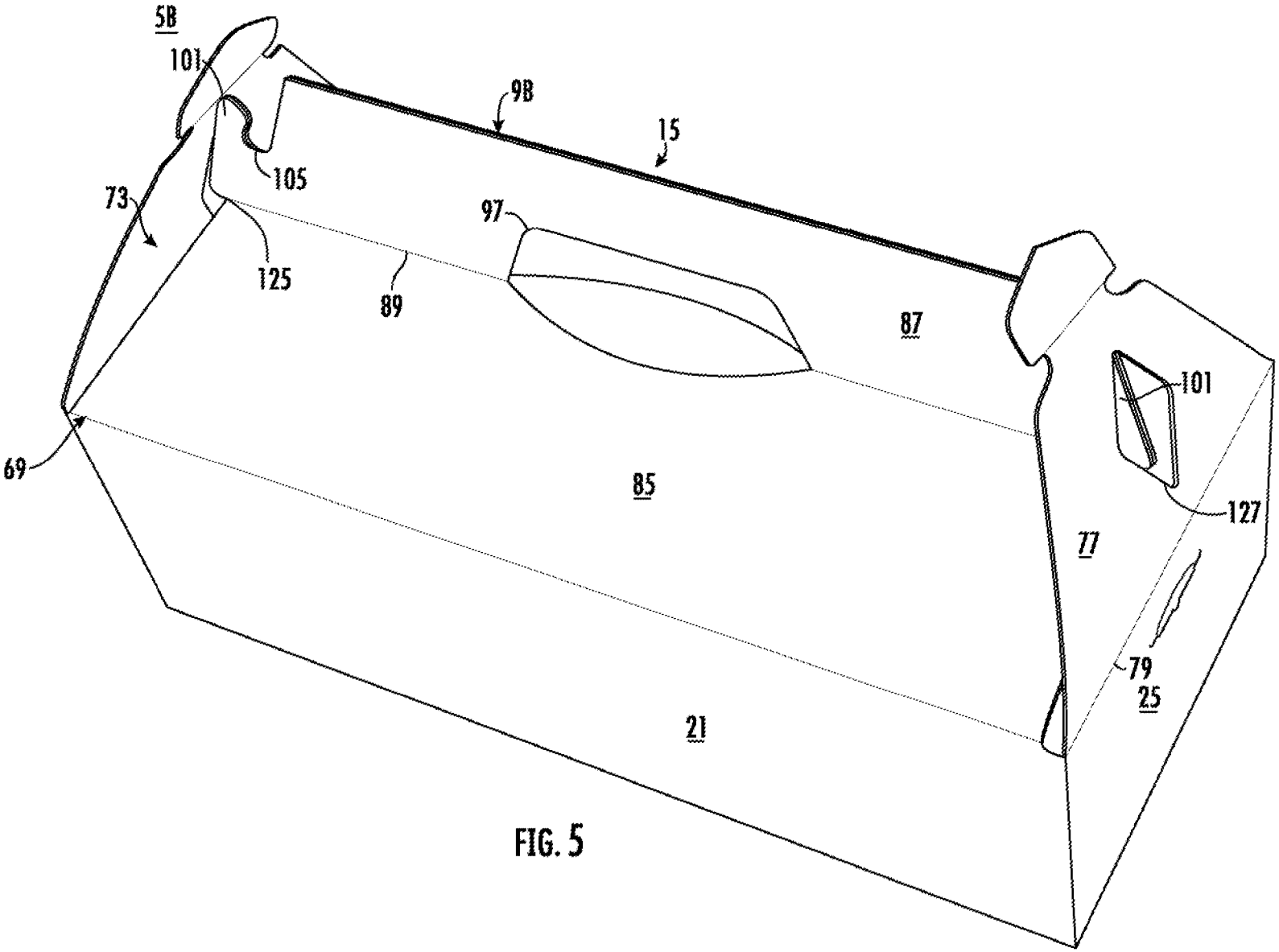
FIG. 5 is a perspective view of the carton of FIG. 3 in a second closed configuration.

Referring additionally to FIG. 5, the carton 5 is shown in a second closed configuration that is generally designated 5B (broadly, "second carton") and having a closed top portion 9B in a second closed configuration. It will be understood that the carton 5B and the closed top portion 9B will be described herein as one reconfigurable configuration of the carton 5 and top portion 9, and that these terms can be used interchangeably. It will be understood that the top portion 9 is reconfigurable between the first closed configuration 9A and the second closed configuration 9B. In the carton 5B, the base portions 85, 91 of the respective top end flaps 69, 81 are folded at the respective fold lines 71, 83 to be obliquely disposed relative to each other and the handle portions 87, 93 of the respective top end flaps 69, 81 are folded upwardly at the respective fold lines 89, 95 relative to the respective base portions 85, 91 such that the handle portions 87, 93 are in at least partial face-to-face contact. In one embodiment, the handle portions 87, 93 can be obliquely disposed relative to one another. As also shown in FIG. 5, the top end flaps 73, 77 are folded at the respective fold lines 75, 79 so that the respective pairs of handle tabs 101, 103 are at least partially inserted through the respective apertures 125, 127 such that the portions of the respective top end flaps 73, 77 surrounding the respective apertures 125, 127 are disposed in the respective notches 105, 107. In this regard, a handle 15 is formed by portions of the top end flaps 69, 73, 77, 81, and can be at least partially grasped by a user through the aligned handle openings 97, 99.

Figure 7:
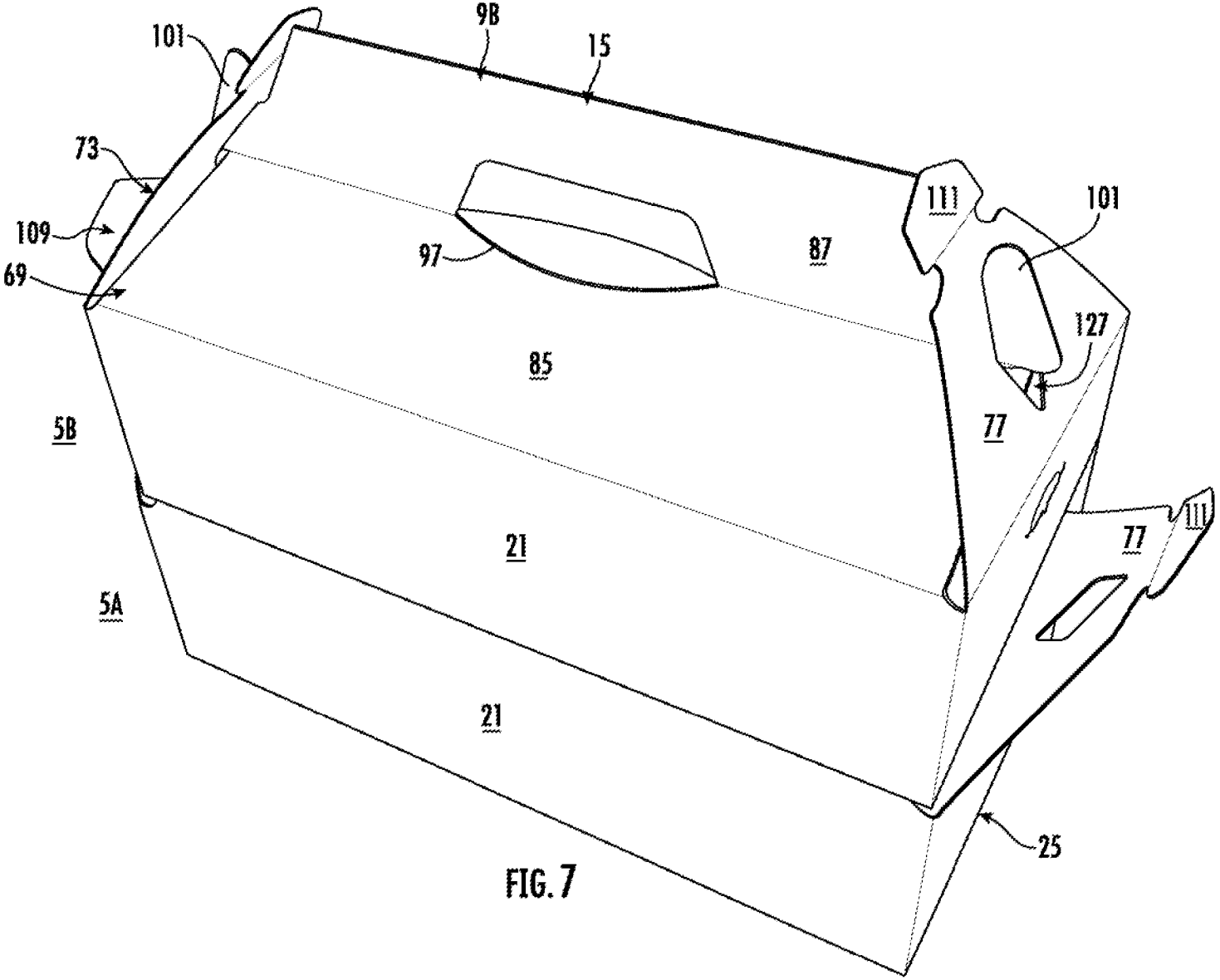
FIG. 7 is a first sequential perspective view of the cartons of FIGS. 4 and 5 being secured to one another.
Figure 8:
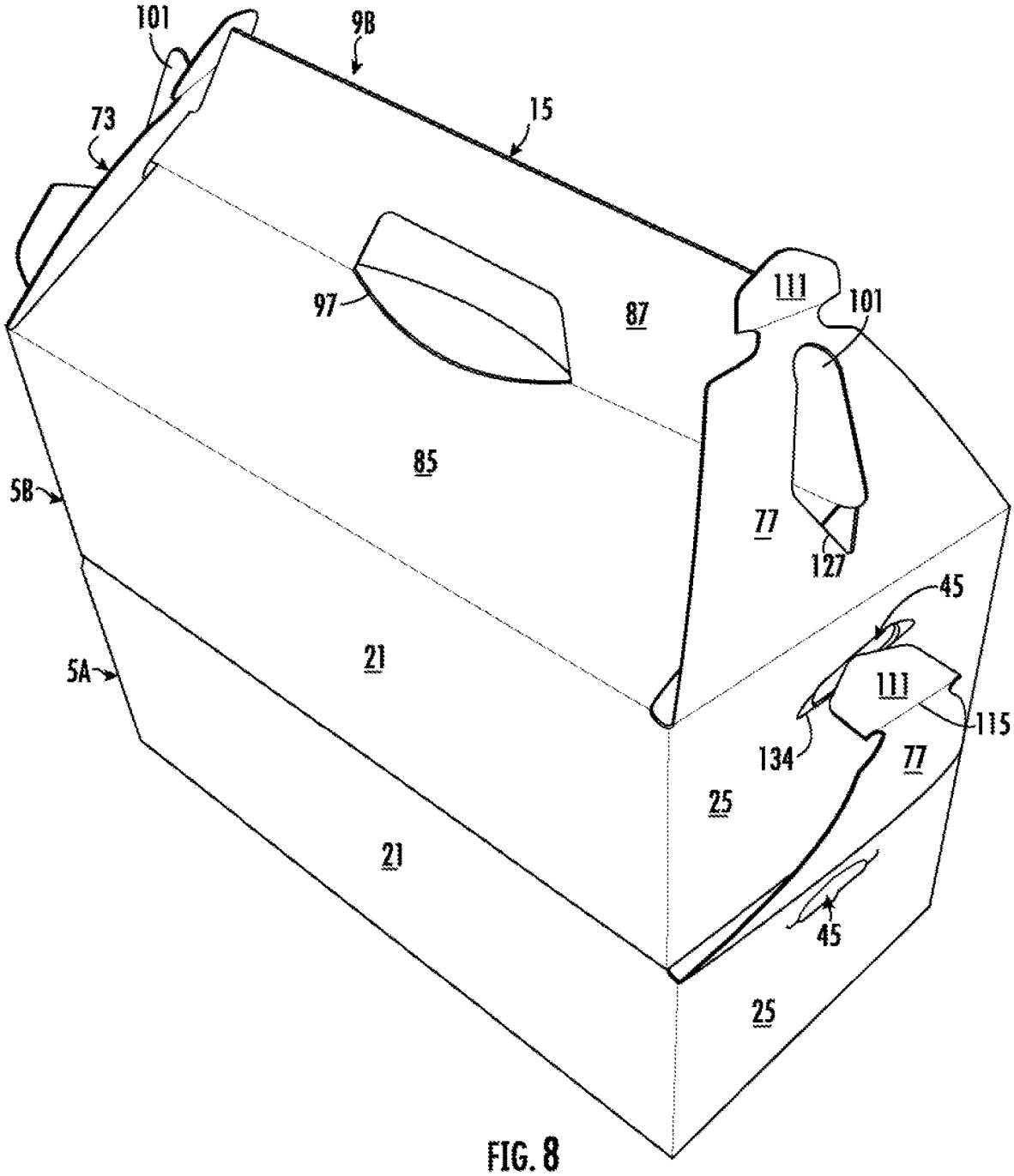
FIG. 8 is a second sequential perspective view of the cartons of FIGS. 4 and 5 being secured to one another.

Still referring to FIG. 1, and referring additionally to FIG. 6, the carton 5A is shown along with the carton 5B. Turning additionally to FIG. 7, the carton 5B having the upright handle 15 can be positioned in the receiving space 13 of the carton 5A with the substantially flat closed top portion 9A. In such a position, the carton 5B is disposed with its respective side panels 23, 25 in facing relation with the respective top end flaps 73, 77 of the carton 5A, as shown. In this regard, the receiving space 13 of the carton 5A provides an at least partial engagement of the carton 5B via the top end flaps 73, 77 when the carton 5B is positioned in the receiving space 13 of the carton 5A. As described further herein, the receiving space 13 of the carton 5A can alternatively receive another carton 5A.

Referring to FIGS. 1 and 7-9, the respective locking tabs 109, 111 of the respective top end flaps 73, 77 of the lower carton 5A can be inserted through respective openings 134 between the respective locking flaps 39, 45 and the respective side panels 23, 25 of the upper carton 5B. In such an arrangement, the locking flaps 39, 45 of the upper carton 5B can be folded interiorly at the respective fold lines 41, 47 and separated from the respective side panels 23, 25 at the respective lines of weakening 43, 49. When inserted through the respective openings 134 of the upper carton 5B, the respective flange portions 117, 119 of the respective locking tabs 109, 111 of the lower carton 5A can engage an interior portion of the respective side panels 23, 25 of the upper carton 5B.

Figure 10:
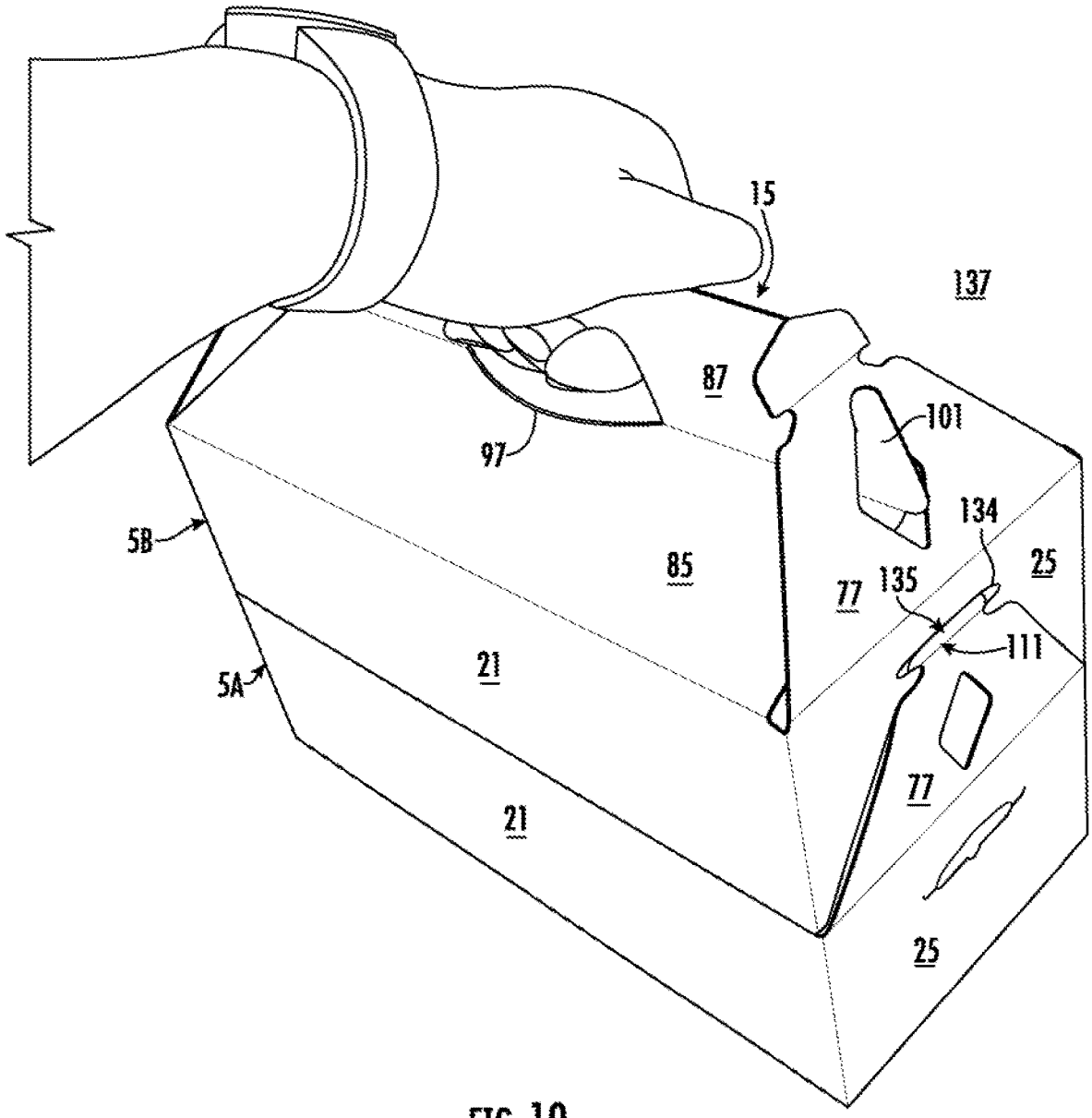
FIG. 10 is a perspective view of the system of FIG. 9 being carried by a user.

As shown in FIGS. 9 and 10, the engagement of the respective locking tabs 109, 111 of the lower carton 5A with the respective openings 134 created by the respective locking flaps 39, 45 of the upper carton 5B forms locking features 133, 135 of a system 137 that includes two or more stacked cartons 5A/5B engaged and secured to one another through the locking features 133, 135. As shown in FIG. 10, the upper carton 5B provides the handle 15 by which the entire system 137 can be carried by a user, for example, since the one or more cartons 5A below the upper carton 5B are secured to the upper carton 5B through the locking features 133, 135. In this regard, the system 137 typically includes an upper carton 5B providing the handle 15, and one or more lower cartons 5A secured to the upper carton 5 and each other through respective locking features 133, 135. In one embodiment, a system can include two or more stacked cartons 5A and secured to each other with respective locking features 133, 135, without a carton 5B. In another embodiment, a carton 5A in the first closed configuration can receive a plurality of smaller cartons 5A/5B in its receiving space 13.

The engagement and securing or locking of multiple cartons 5 to one another in the system 137 as described herein provides a convenient, unitary structure through which more food products can be stored and carried, for example, as compared to a single carton 5. Further, the reconfiguration of the top portion 9 of the carton 5 between the first closed configuration (closed top portion 9A of carton 5A) in which the top portion 9 is flat and the second closed configuration (closed top portion 9B of carton 5B) in which the handle 15 is provided allows each carton 5 in the system 137 to be selectively reconfigurable as the uppermost or a lower carton 5 in the system 137. While the system 137 has been described herein as including two cartons 5, in embodiments, more than two cartons 5 secured to one another with locking features 133, 135 can form the system 137.

Figure 11:
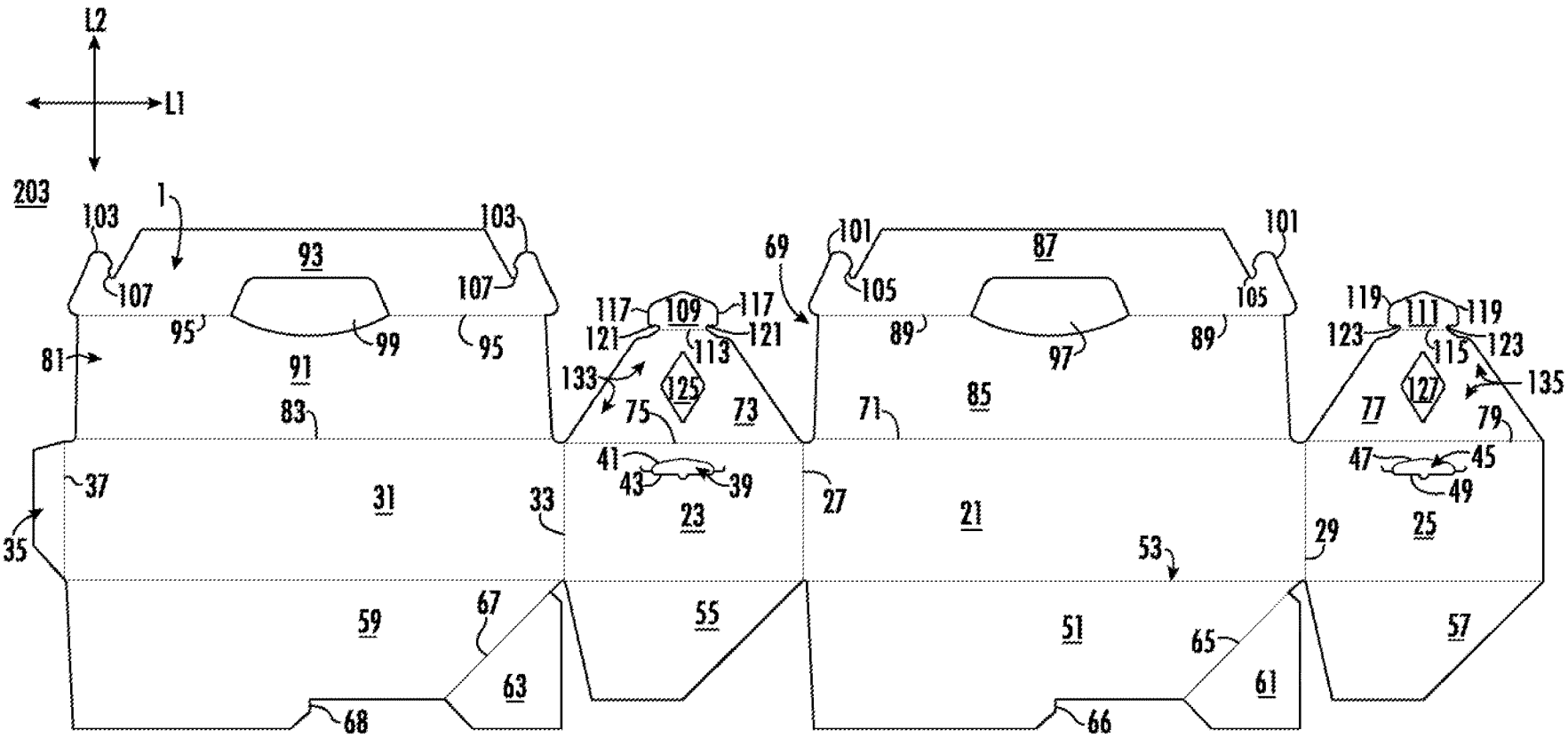
FIG. 11 is a plan view of a blank for forming a carton according to a second exemplary embodiment of the disclosure.
Figure 12:
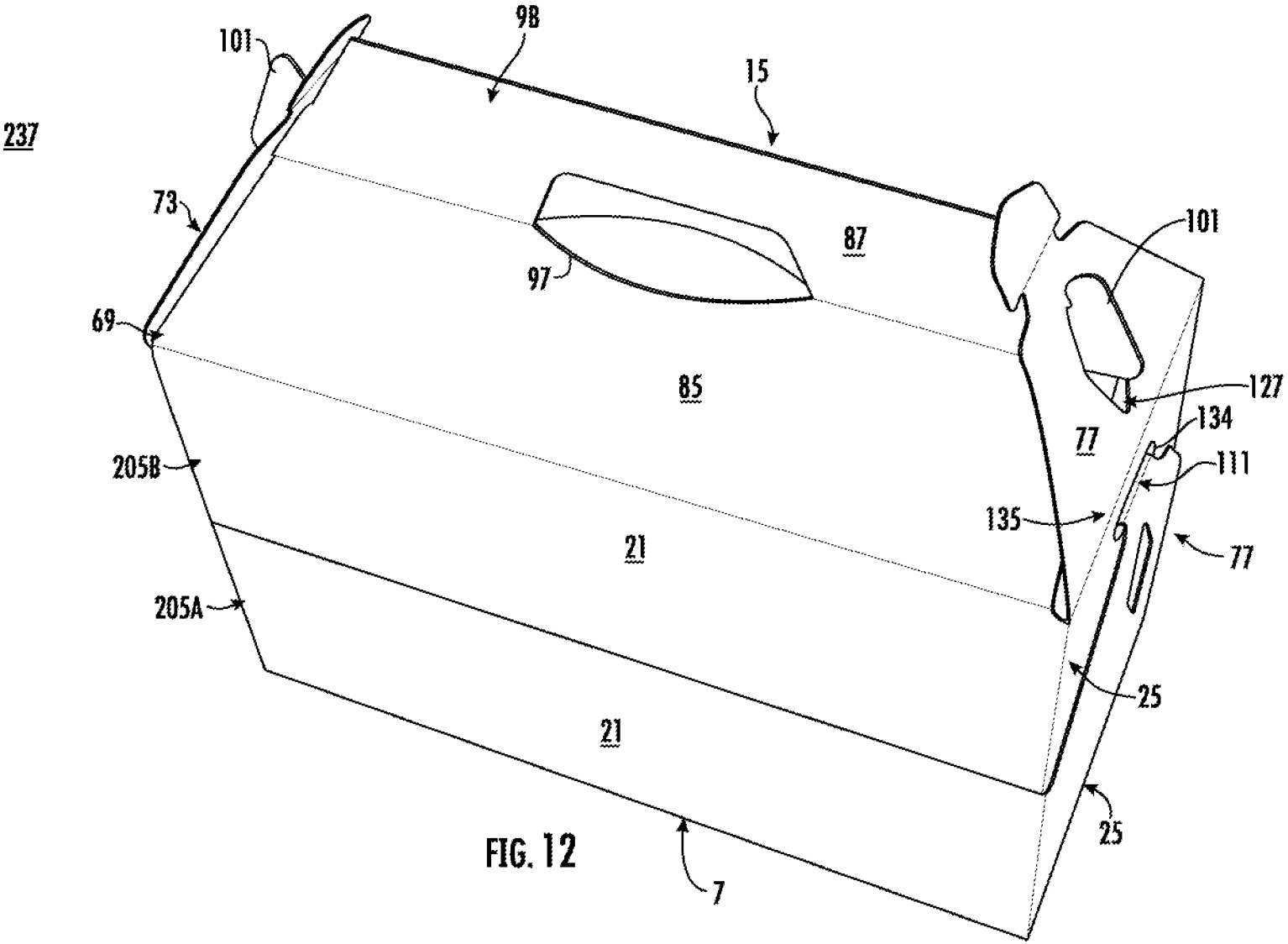
FIG. 12 is a perspective view of a system including cartons formed from the blank of FIG. 11 according to the second exemplary embodiment of the disclosure.

Turning to FIG. 11, a blank 203 for forming a carton according to a second exemplary embodiment of the disclosure is illustrated. The second exemplary embodiment of the disclosure is similar to the first exemplary embodiment except that the front and back panels 21, 31 of the blank 203 are longer than the front and back panels 21, 31 of the blank 3, and like or similar reference numbers are indicated throughout the drawings to indicate like or similar features. In one embodiment, the front and back panels 21, 31 of the blank 203 have a length of about 10.5 inches along the longitudinal axis L1, while the front and back panels 21, 31 of the blank 103 (FIG. 1) have a length of about 7.5 inches along the longitudinal axis L1. Referring additionally to FIG. 12, the blank 203 can be used to form cartons 205A, 205B (broadly, "first carton" and "second carton", respectively) having similar configurations to the cartons 5A, 5B (FIG. 6) of the first embodiment described above, and which can be reconfigured and/or secured to one or more other cartons 205A/205B to form a carton system or system 237 similar to the system 137 (FIG. 9) of the first embodiment described above. It will be understood that the cartons 205A, 205B described herein are different configurations of a carton formed from the blank 203.

Figure 13:
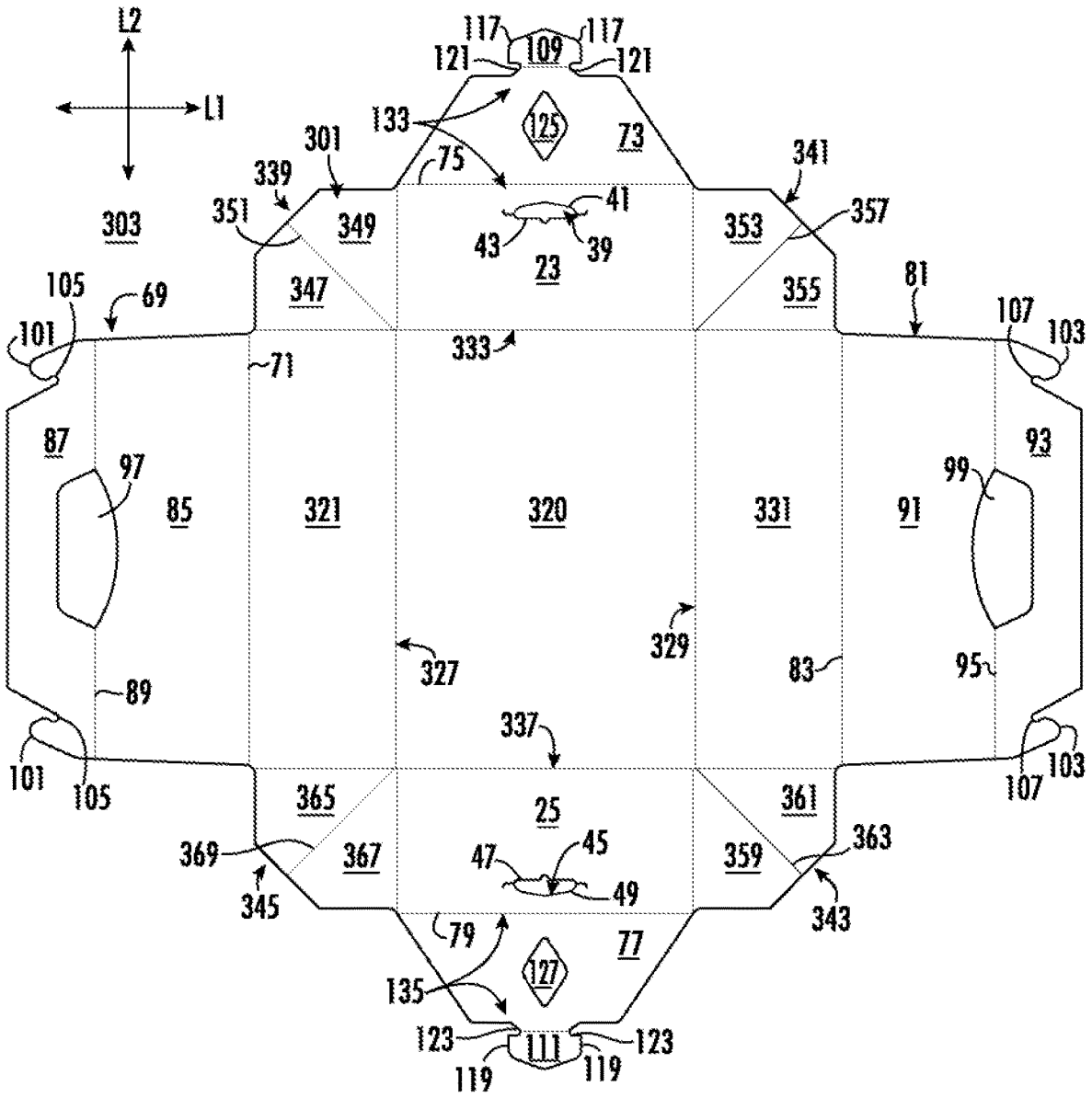
FIG. 13 is a plan view of a blank for forming a carton according to a third exemplary embodiment of the disclosure.

Turning to FIG. 13, an exterior surface 301 of a blank 303 for forming a carton 305 (FIG. 14) according to a third exemplary embodiment of the disclosure is illustrated. The third exemplary embodiment of the disclosure includes one or more features that are similar to those of the first and second exemplary embodiments of the disclosure, and similar or identical reference numbers are used to designate identical or similar features. As described herein, the carton 305 includes a leak-resistant bottom receptacle 312 that is substantially devoid of adhered or otherwise coupled surfaces, openings, or other discontinuities.

As shown, the blank 303 includes a bottom panel 320 and a front panel 321 and a back panel 331 foldably connected to the bottom panel 320 at respective lateral fold lines 327, 329. The first side panel 23 is foldably connected to the bottom panel 320 at a longitudinal fold line 333 and the second side panel 25 is foldably connected to the bottom panel 320 at a longitudinal fold line 337. As also shown, the blank 303 includes the top end flaps 69, 73, 77, 81 and the locking flaps 39, 45 having substantially similar features to those described above with respect to the first and second exemplary embodiments.

The illustrated blank 303 also includes a first gusset 339 foldably connected to each of the front panel 321 and the first side panel 23, a second gusset 341 foldably connected to each of the first side panel 23 and the back panel 331, a third gusset 343 foldably connected to each of the back panel 331 and the second side panel 325, and a fourth gusset 345 foldably connected to each of the second side panel 25 and the front panel 321. The first gusset 339 includes a first gusset panel 347 foldably connected to the front panel 321 at a portion of the longitudinal fold line 333 and a second gusset panel 349 foldably connected to the first gusset panel 347 at an oblique fold line 351 and foldably connected to the first side panel 23 at a portion of the lateral fold line 327. The second gusset 341 includes a third gusset panel 353 foldably connected to the first side panel 23 at a portion of the lateral fold line 329 and a fourth gusset panel 355 foldably connected to the third gusset panel 353 at an oblique fold line 357 and foldably connected to the back panel 331 at a portion of the longitudinal fold line 333. The third gusset 343 includes a fifth gusset panel 359 foldably connected to the second side panel 25 at a portion of the lateral fold line 329 and a sixth gusset panel 361 foldably connected to the fifth gusset panel 359 at an oblique fold line 363 and foldably connected to the back panel 331 at a portion of the longitudinal fold line 337. The fourth gusset 345 includes a seventh gusset panel 365 foldably connected to the front panel 321 at a portion of the longitudinal fold line 337 and an eighth gusset panel 367 foldably connected to the seventh gusset panel 365 at an oblique fold line 369 and foldably connected to the second side panel 25 at a portion of the lateral fold line 327.

Figure 14:
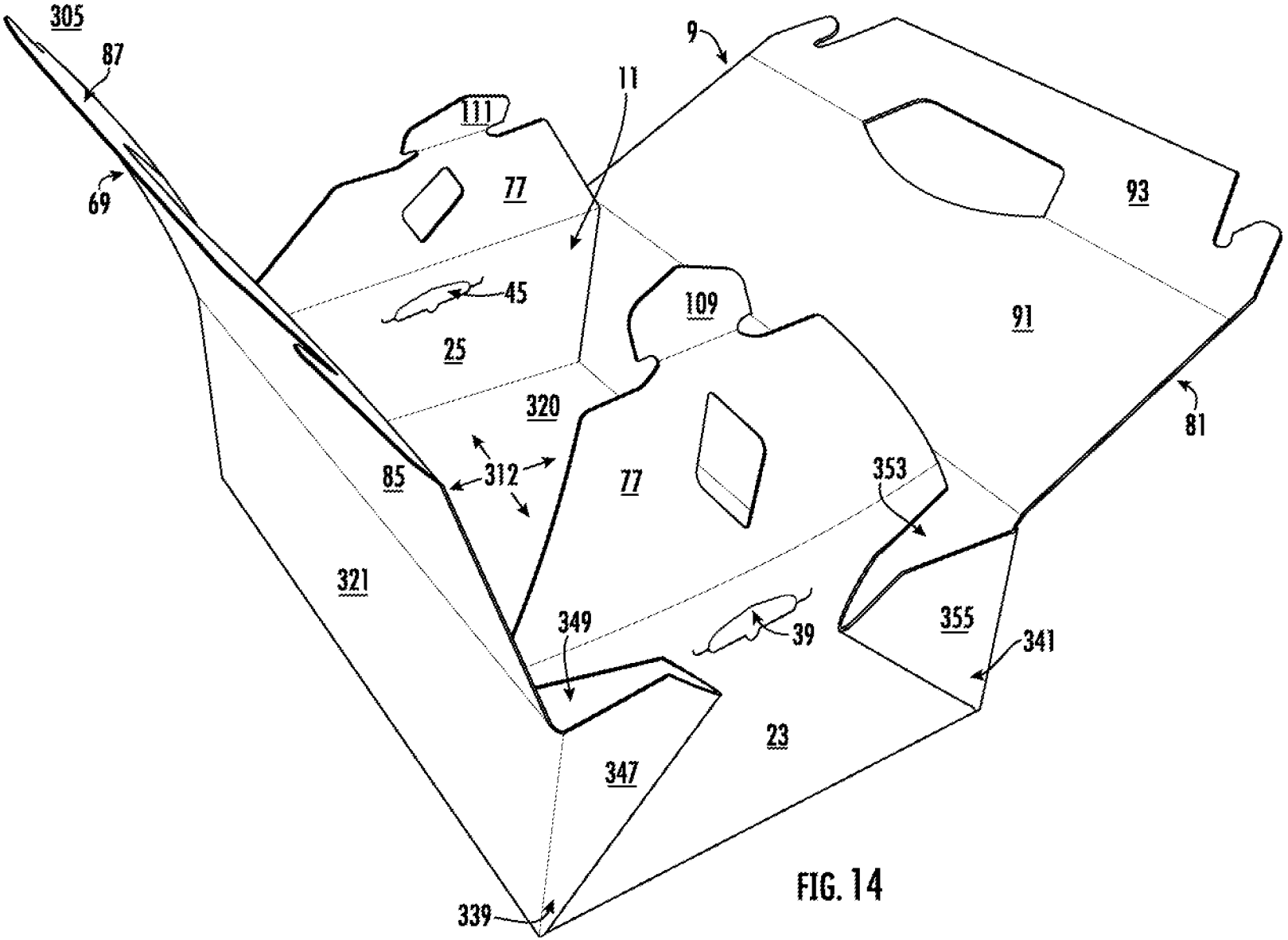
FIG. 14 is a perspective view of a partial assembly of the blank of FIG. 13.

Referring additionally to FIG. 14, the panels 321, 23, 331, 25 can be folded upright relative to the bottom panel 320 to partially form the interior 11 of the carton 305. In one embodiment, the front panel 321 is folded at the fold line 327 into a generally upright position relative to the bottom panel 320, the back panel 331 is folded at the fold line 329 into a generally upright position relative to the bottom panel 320, and the respective first and second side panels 23, 25 are folded at the respective fold lines 333, 337 into a generally upright position relative to the bottom panel 320. The first gusset panel 347 can be folded at the fold line 351 into at least partial face-to-face contact with the second gusset panel 349, and the second gusset panel 349 can be folded at the fold line 327 into at least partial face-to-face contact with the first side panel 23. In such an arrangement of the first gusset 341, folding of the second gusset panel 349 at the fold line 327 can draw the front panel 321 into generally intersecting relation with the first side panel 23. The fourth gusset panel 355 can be folded at the fold line 357 into at least partial face-to-face contact with the third gusset panel 353, and the third gusset panel 353 can be folded at the fold line 329 into at least partial face-to-face contact with the first side panel 23. In such an arrangement of the second gusset 341, folding of the third gusset panel 353 at the fold line 329 can draw the back panel 331 into generally intersecting relation with the first side panel 23. The sixth gusset panel 361 can be folded at the fold line 363 into at least partial face-to-face contact with the fifth gusset panel 359, and the fifth gusset panel 359 can be folded at the fold line 329 into at least partial face-to-face contact with the second side panel 25. In such an arrangement of the third gusset 343, folding of the fifth gusset panel 359 at the fold line 329 can draw the back panel 331 into generally intersecting relation with the second side panel 25. The seventh gusset panel 365 can be folded at the fold line 369 into at least partial face-to-face contact with the eighth gusset panel 367, and the eighth gusset panel 367 can be folded at the fold line 327 into at least partial face-to-face contact with the second side panel 25. In such an arrangement of the fourth gusset 345, folding of the eighth gusset panel 367 at the fold line 327 can draw the front panel 321 into generally intersecting relation with the second side panel 25. The gussets 339, 341, 343, 345 can be maintained in the above-described arrangements with one or more adhesives such as glue.

As shown, the above-described arrangement of the panels 321, 331, 23, 25 and the gussets 339, 341, 343, 345 provides an open configuration of the carton 305 in which the interior 11 of the carton 305 is accessible. As also shown, the arrangement of the gussets 339, 341, 343, 345 between the respective panels 321, 23, 331, 25 provides a substantially leak-resistant bottom receptacle 312 that is substantially devoid of adhered or otherwise coupled surfaces, openings, or other discontinuities. For example, proceeding in a clockwise order from the perspective of the blank 303, the front panel 321, the first gusset panel 347, the second gusset panel 349, the first side panel 23, the third gusset panel 353, the fourth gusset panel 355, the back panel 331, the sixth gusset panel 361, the fifth gusset panel 359, the second side panel 25, the eighth gusset panel 367, and the seventh gusset panel 365 (all of which are foldably connected to the bottom panel 320), provide a substantially continuous surface that at least partially forms the bottom receptacle 312 that is joined only by respective fold lines 333, 351 327, 329, 357, 333, 337, 363, 329, 327, 369, 337 such that the panels 321, 347, 349, 23, 353, 355, 331, 361, 359, 25, 367, 365 together with the bottom panel 320, can maintain one or more fluids in the bottom receptacle 312 and inhibit, minimize, and/or prevent the passage of such one or more fluids from the bottom receptacle 312 into the surrounding environment. In this regard, the bottom receptacle 312 provides a substantially leak-proof or leak-resistant configuration. In one embodiment, the blank 303/carton 305 can be provided with an interior liner suitable for contact with one or more fluids and arranged to inhibit, minimize, and/or prevent the passage of such one more fluids therethrough, for example, a polymeric material. Such material and/or properties can also be applied to the blank 303/carton 305 as a surface treatment or coating.

Figure 15:
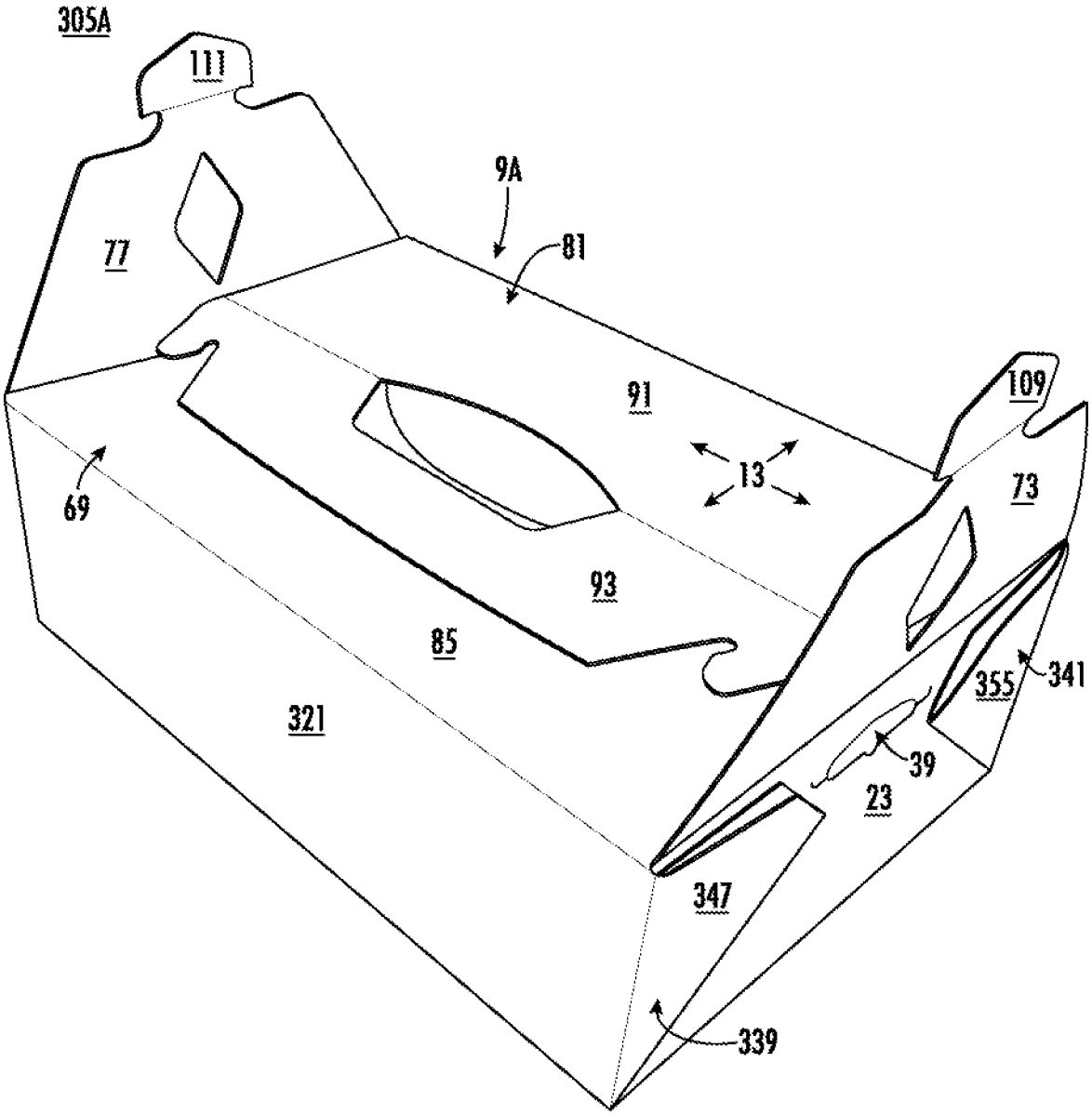
FIG. 15 is a perspective view of a carton formed from the blank of FIG. 13 in a first closed configuration according to the third exemplary embodiment of the disclosure.
Figure 16:
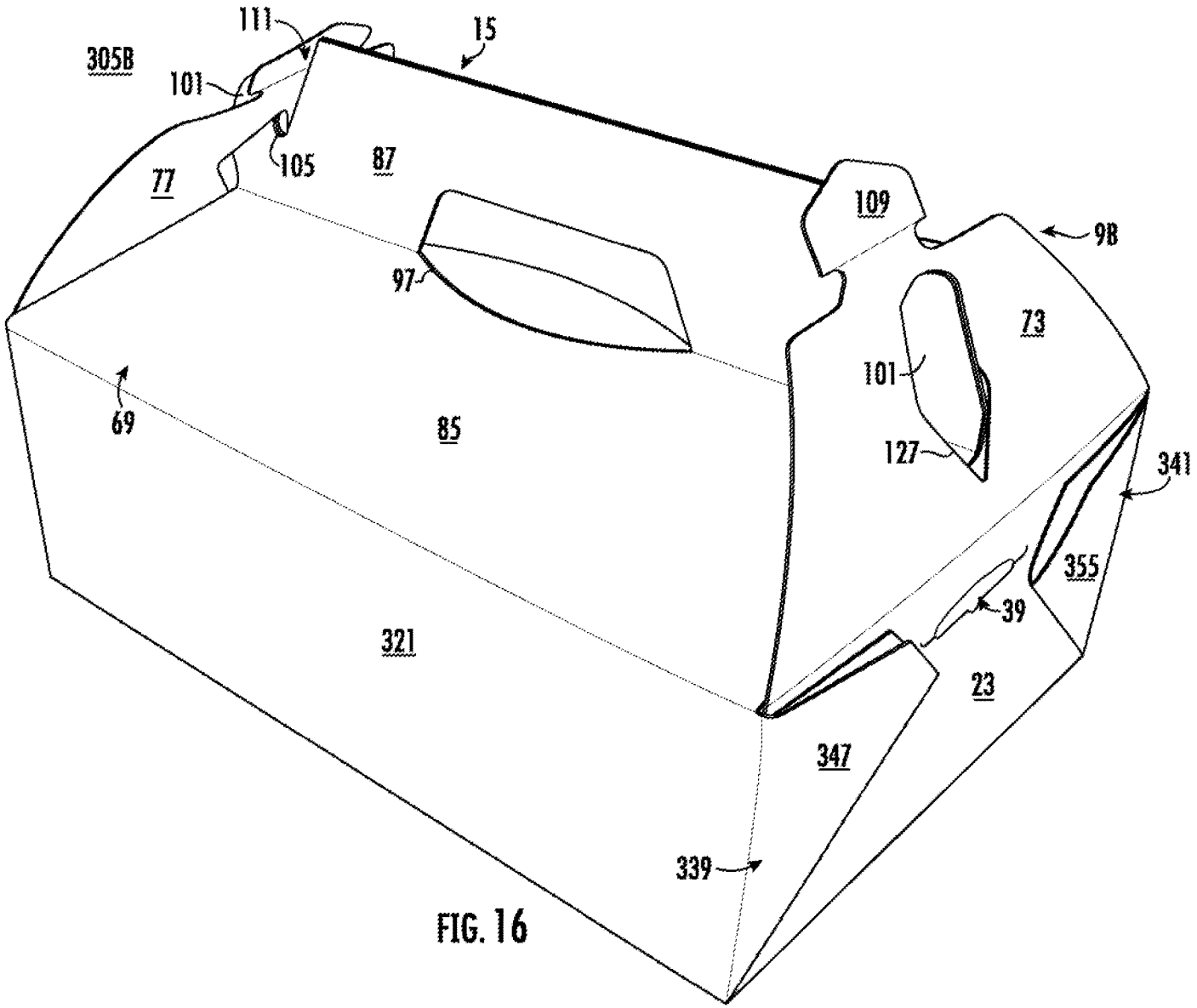
FIG. 16 is a perspective view of a carton formed from the blank of FIG. 13 in a second closed configuration according to the third exemplary embodiment of the disclosure.
Figure 17:
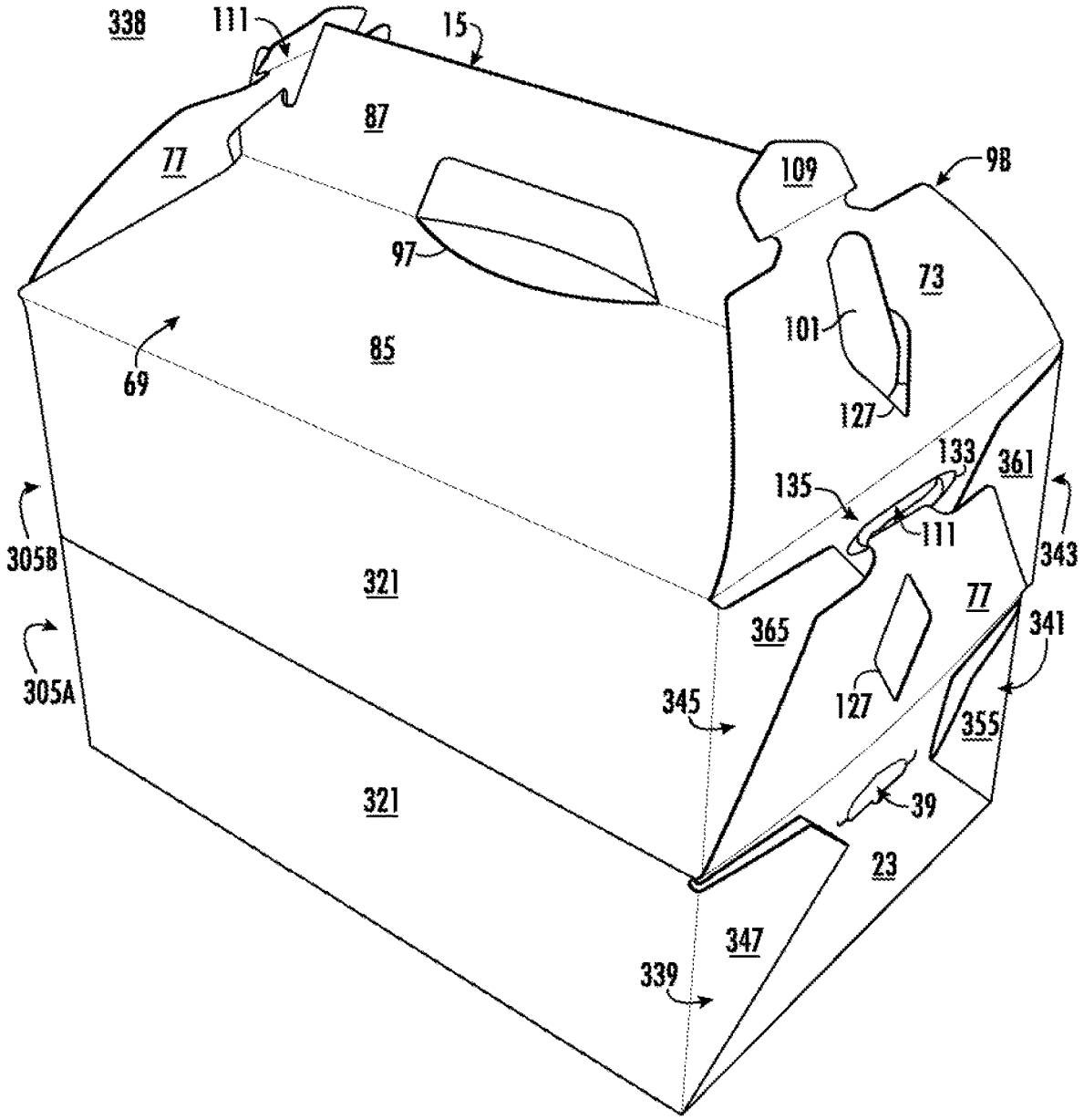
FIG. 17 is a perspective view of a system including the cartons of FIGS. 15 and 16 according to the third exemplary embodiment of the disclosure.

Referring additionally to FIGS. 15-17, the top portion 9 of the carton 305 can be closed into respective first and second closed top portions 9A, 9B of respective 305A, 305B (broadly, "first carton" and "second carton", respectively) in the manner described above with respect to the cartons 5A, 5B, 205A, 205B (FIGS. 6, 12). Accordingly, and as shown in FIG. 17, the carton 305A has the receiving space 13 to receive another carton 305A or a carton 305B to form a carton system or system 338 of cartons 305A, 305B that are engaged with and secured to each other with respective locking features 133, 135 similar to the systems 137, 237 (FIG. 9, 12) described above with respect to the first and second exemplary embodiments. In this regard, cartons 305A, 305B of the system 338 each have a bottom receptacle 312 that provides a substantially leak-proof or leak-resistant configuration to each carton 305 of the system 338. It will be understood that the cartons 305A, 305B are described herein as different configurations of the carton 305 (having respective closed top portions 9A, 9B), and that these terms can be used interchangeably.

Figure 18:
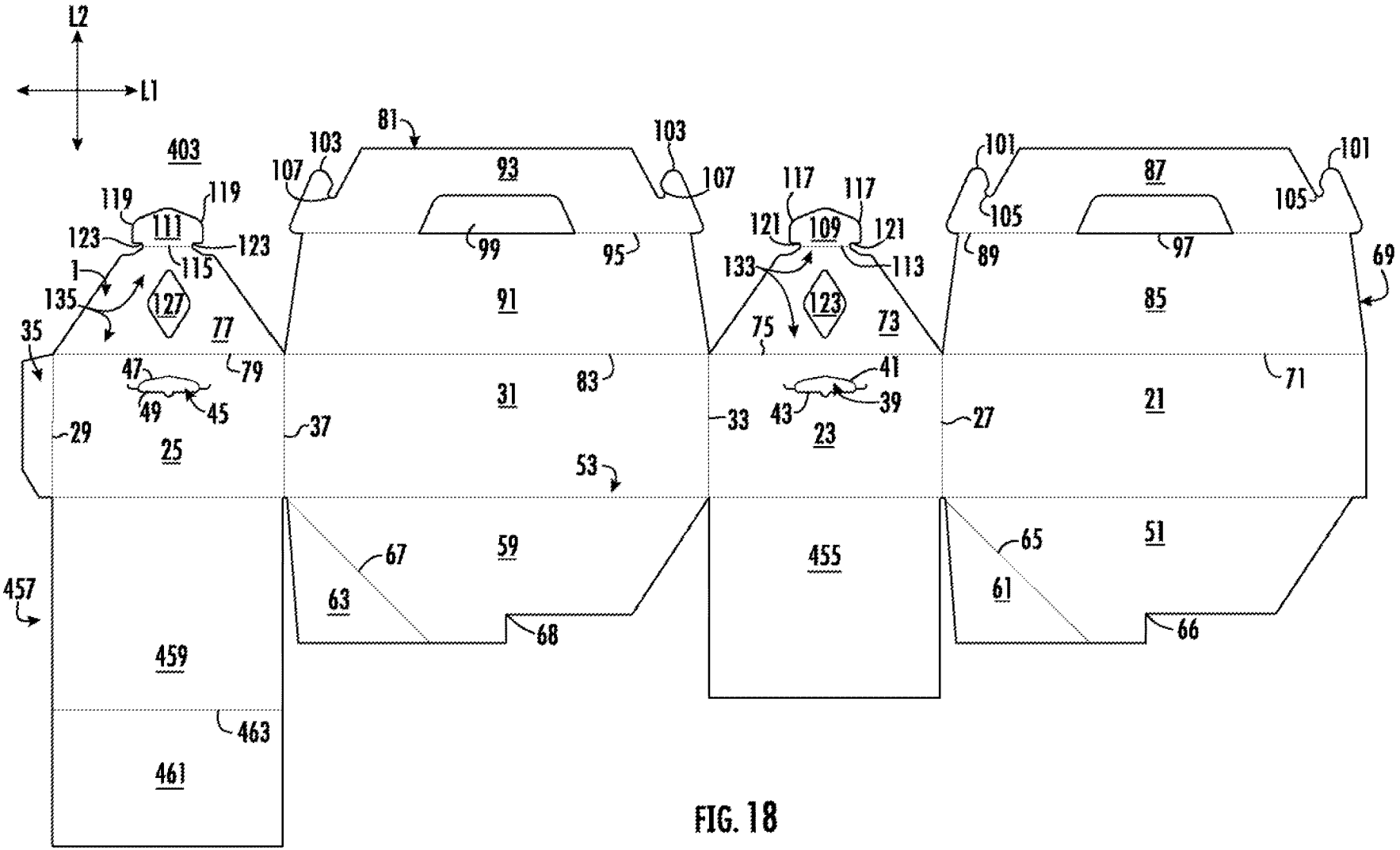
FIG. 18 is a plan view of a blank for forming a carton according to a fourth exemplary embodiment of the disclosure.

Referring to FIG. 18, a blank 403 for forming a carton 405 (FIG. 20) according to a fourth exemplary embodiment of the disclosure is illustrated. The fourth exemplary embodiment of the disclosure includes one or more features that are similar to those of the first, second, and third exemplary embodiments of the disclosure, and similar or identical reference numbers are used to designate identical or similar features. As described herein, the carton 405 includes a divider flap 457 that is positionable to partition an interior 11 of the carton 405.

The illustrated blank 403 includes the first side panel 23, the second side panel 25, the front panel 21, the back panel 31, and the attachment flap 35. As shown, the second side panel 25 is foldably connected to the attachment flap 35 at the lateral fold line 29, and the front panel 21 is disposed along a free edge portion of the blank 403. The blank 403 also includes the top end flaps 69, 73, 77, 81 and the locking flaps 39, 45 having substantially similar features to those described above with respect to the first, second, and third exemplary embodiments, as well as the bottom end flaps 51, 59 and marginal tabs 61, 63 having substantially similar features to those described above with respect to the first and second exemplary embodiments.

Still referring to FIG. 18, a bottom end flap 455 is foldably connected to the first side panel 23 at a portion of the longitudinal fold line 53 and a bottom end flap 457 is foldably connected to the second side panel 25 at a portion of the longitudinal fold line 53. As shown, the bottom end flap 457 includes a proximal section 459 foldably connected to the second side panel 25 at the longitudinal fold line 53 and a distal section 461 foldably connected to the proximal section 459 at a longitudinal fold line 463.

Figure 19:
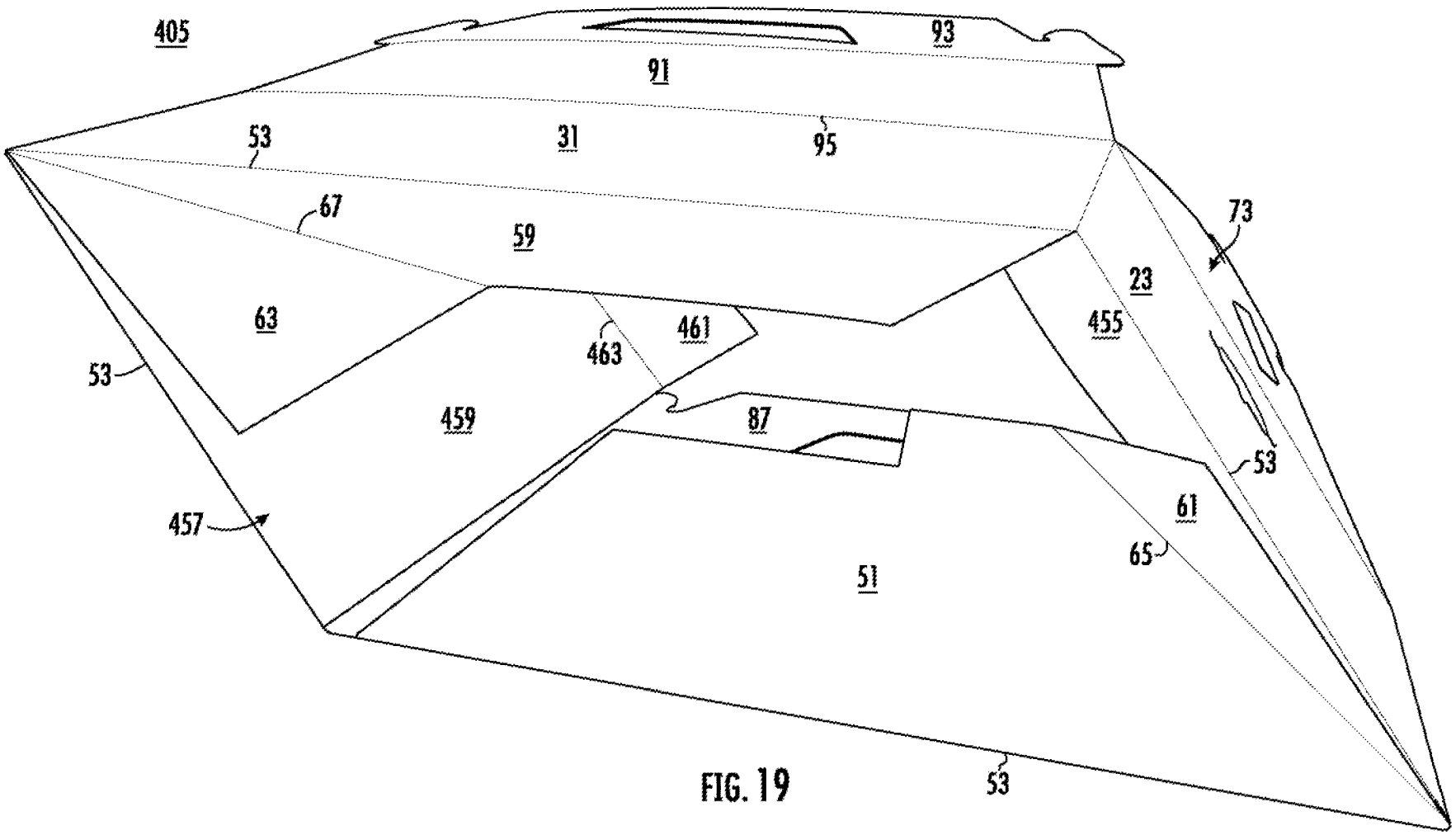
FIG. 19 is a perspective view of a partial assembly of the blank of FIG. 18.
Figure 20:
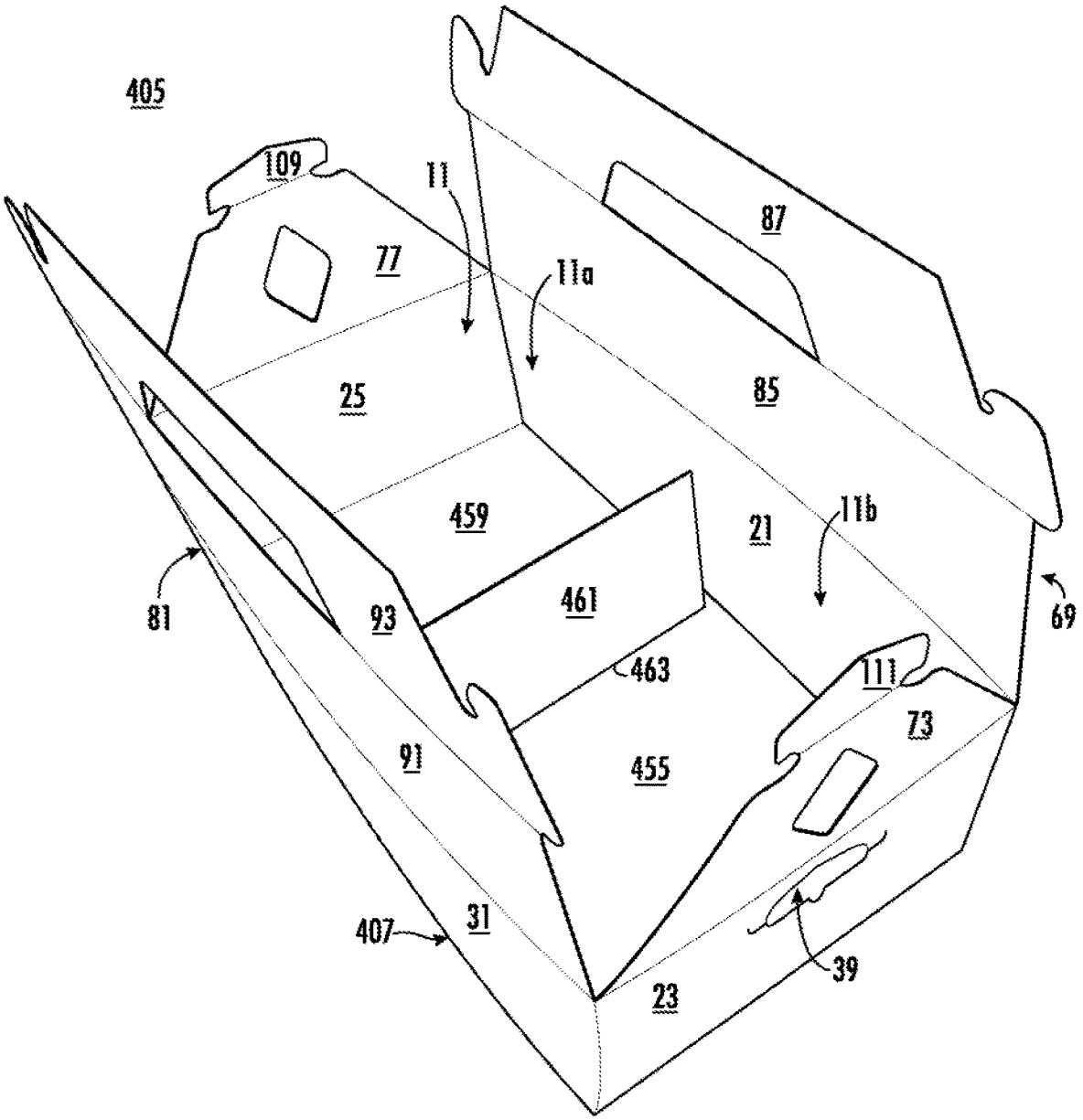
FIG. 20 is a perspective view of a carton formed from the blank of FIG. 18 in an open configuration according to the fourth exemplary embodiment of the disclosure.

Still referring to FIG. 18, and referring additionally to FIGS. 19 and 20, erection of the carton 405 (FIG. 20) from the blank 403 according to one exemplary embodiment of the disclosure will be described. As shown, the attachment flap 35 can be positioned into at least partial face-to-face contact with the back panel 31, for example, via folding of the back panel 31 at the fold line 33 and folding of the second side panel 25 at the fold line 37, and can be secured thereto with an adhesive such as glue. The front panel 21, the first side panel 23, the second side panel 25, the back panel 31, and the attachment flap 35 can be folded at fold lines 27, 29, 33, 37 such that the front and back panels 21, 31 are substantially parallel to one another and the side panel 23 is substantially parallel to the second side panel 25 and the attachment flap 35. The bottom end flaps 51, 455, 457, 59 can be folded at respective portions of fold line 53 in overlapping relation to form a closed bottom 407 of the carton 405. In one embodiment, the notches 66, 68 of the respective bottom end flaps 51, 59 interengage one another, the bottom end flap 455 overlaps the bottom end flaps 51, 59, and the bottom end flap 457 overlaps the bottom end flap 455. In this regard, the closed bottom 407 is formed such that the distal section 461 of the bottom end flap 457 can be folded upwardly at the fold line 463 into a generally upright position in the interior 11 of the carton 405. In one embodiment, the upright positioning of the distal section 461 of the bottom end flap 457 can be maintained, for example, through frictional engagement of an edge of the distal section 461 with the front panel 21 and/or the back panel 31. In this regard, the interior 11 of the carton 405 can be partitioned by the distal section 461 of the bottom end flap 457 into a first interior section 11*a* and a second interior section 11*b* on either side of the distal section 461 of the bottom end flap 457, for example, to provide separation of different food products and/or to apportion one or more food products. In one embodiment, one or both of the first interior section 11*a* and the second interior section 11*b* can be used to provide an accessory or condiment for a food product such that one or both of the first interior section 11*a* and the second interior section 11*b* can provide a serving tray. In another embodiment, the distal section 461 of the bottom end flap 457 can optionally be positioned in a substantially flat or planar position relative to the remainder of the closed bottom 407 such that no partitioning of the interior 11 of the carton 405 is provided.

Figure 21:
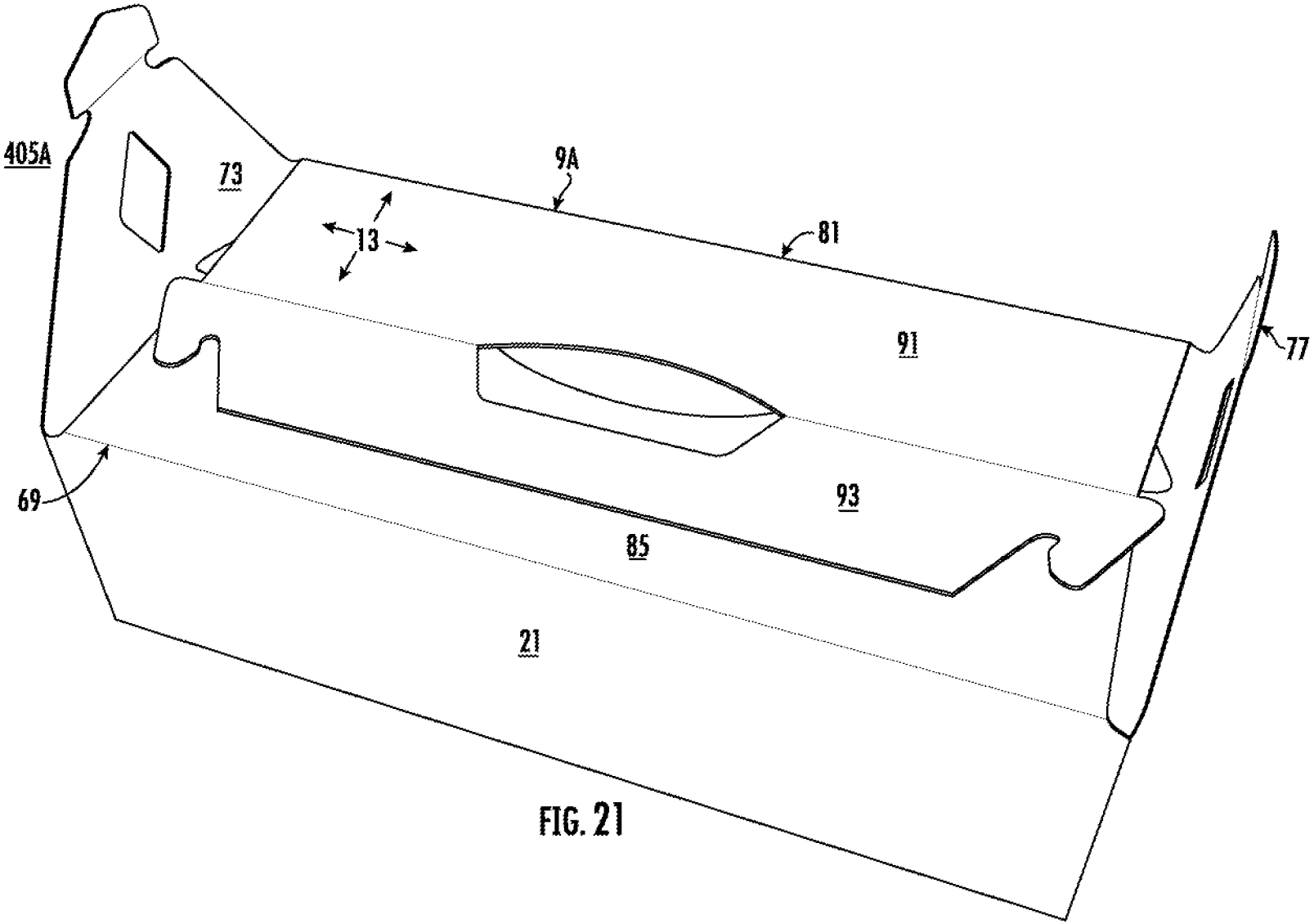
FIG. 21 is a perspective view of the carton of FIG. 20 in a first closed configuration.
Figure 22:
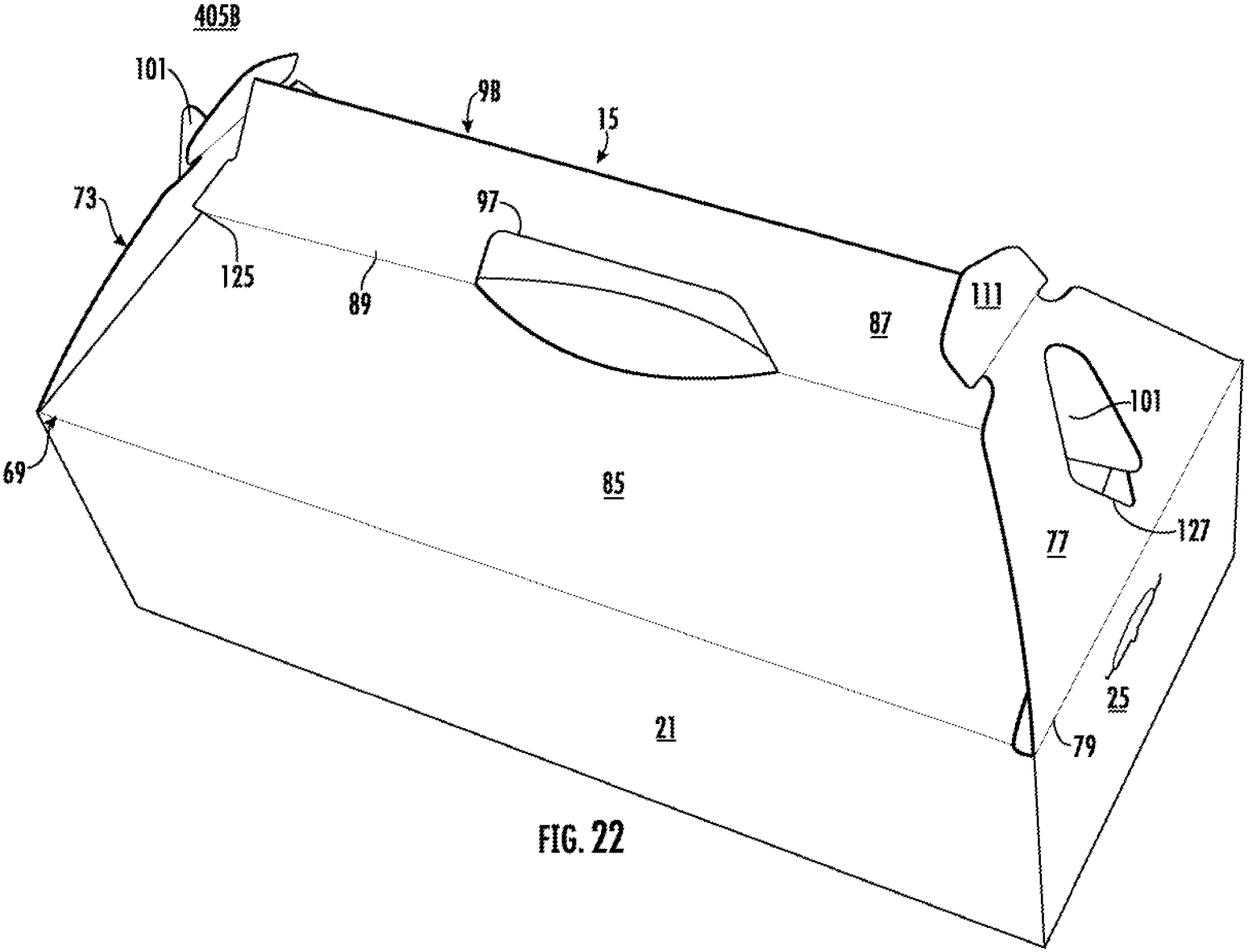
FIG. 22 is a perspective view of the carton of FIG. 20 in a second closed configuration.
Figure 23:
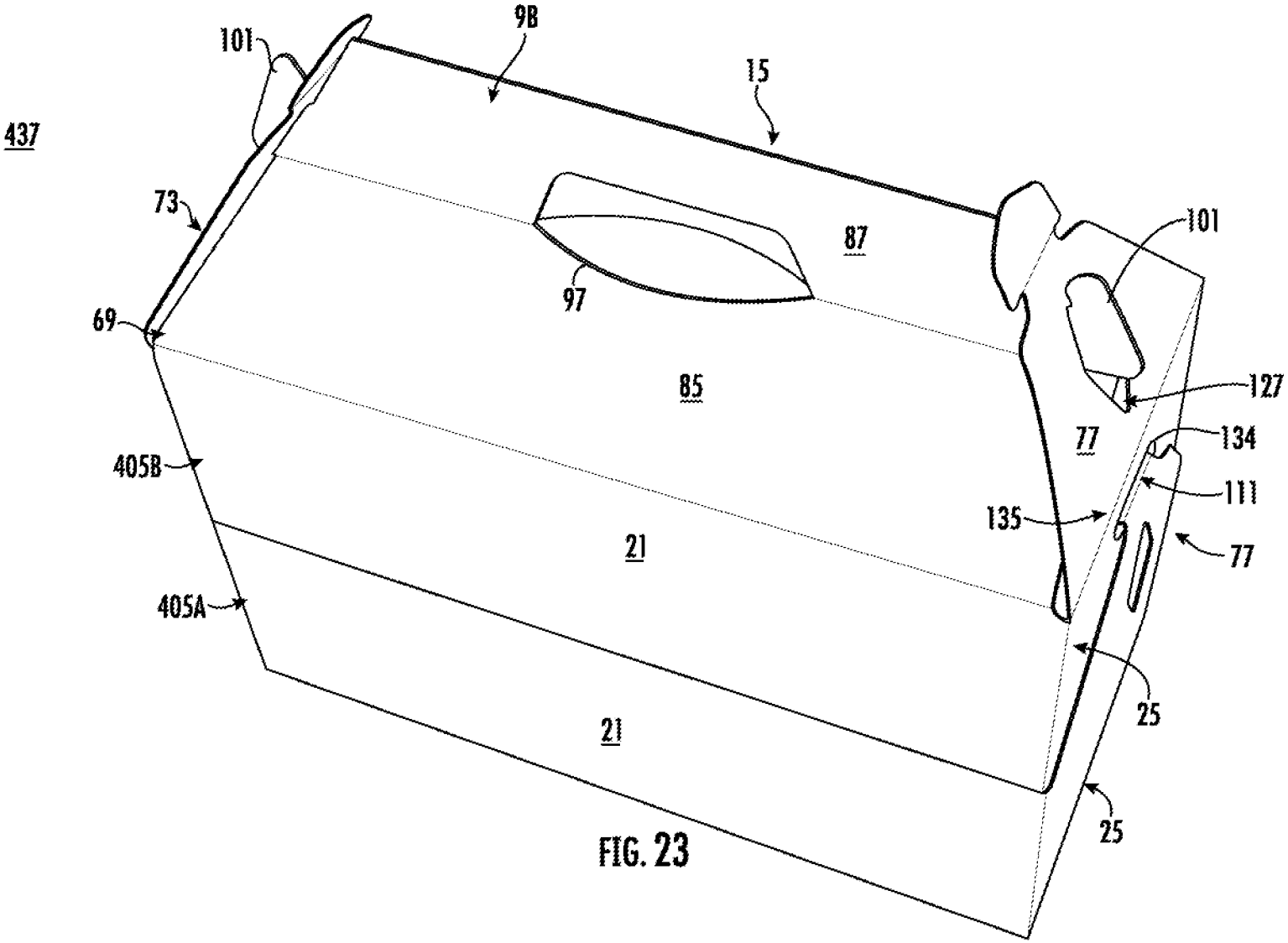
FIG. 23 is a perspective view of a system including the cartons of FIGS. 21 and 22 according to the fourth exemplary embodiment of the disclosure.

Referring additionally to FIGS. 21-23, the top portion 9 of the carton 405 can be closed into respective first and second closed top portions 9A, 9B of respective cartons 405A, 405B (broadly, "first carton" and "second carton", respectively) in the manner described above with respect to the cartons 5A, 5B, 205A, 205B, and 305A, 305B (FIGS. 6, 12, 17). Accordingly, and as shown, the carton 405A can have the receiving space 13 to receive a carton 405B to form a carton system or system 437 of cartons 405A, 405B that are secured to each other with respective locking features 133, 135 similar to the systems 137, 237, 338 (FIGS. 9, 12, 17) described above with respect to the first, second, and third exemplary embodiments. It will be understood that the cartons 405A, 405B are described herein as different configurations of the carton 405 (having respective closed top portions 9A, 9B), and that these terms can be used interchangeably.

Any of the features of the various embodiments of the disclosure can be combined with, replaced by, or otherwise configured with other features of other embodiments of the disclosure without departing from the scope of this disclosure. Further, the panels, flaps, and/or other features shown and described in conjunction with the blanks, The cartons according to the present disclosure can be, for example, formed from blanks of coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels, flaps, or features, adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding one or more articles, the carton comprising:

a plurality of panels extending at least partially around an interior of the carton, the plurality of panels comprising a front panel, a back panel, a first side panel, and a second side panel;

a plurality of end flaps foldably connected to respective panels of the plurality of panels and forming a closed top portion of the carton, the plurality of end flaps comprising a first top end flap foldably connected to the front panel, a second top end flap foldably connected to the back panel, a third top end flap foldably connected to the first side panel at a first fold line, and a fourth top end flap foldably connected to the second side panel at a second fold line, at least one of the first top end flap and the second top end flap comprising at least one handle tab and a handle portion comprising a top edge of the at least one of the first top end flap and the second top end flap, at least one of the third top end flap and the fourth top end flap comprising an aperture for at least partially receiving the at least one handle tab, the closed top portion of the carton is reconfigurable between a first configuration having a substantially flat profile and a second configuration wherein the handle portion forms a handle of the carton; and locking features for engaging at least one other carton, the locking features comprise a first locking tab foldably connected to the third top end flap at a third fold line and a second locking tab foldably connected to the fourth top end flap at a fourth fold line, the first locking tab is spaced away from the first side panel and the second locking tab is spaced away from the second side panel such that the third fold line is spaced away from the first fold line and such that the fourth fold line is spaced away from the second fold line, each of the first locking tab and the second locking tab has a respective pair of flange portions and a respective pair of notches between the respective flange portions and the respective third end flap and fourth top end flap, each of the first locking tab and the second locking tab extends above the top edge of the at least one of the first top end flap and the second top end flap when the closed top portion of the carton is in the second configuration.

2. The carton of claim 1, wherein the locking features further comprise at least one locking flap foldably connected to at least one panel of the plurality of panels, the at least one locking flap is at least partially separable from the at least one panel of the plurality of panels for forming an opening for at least partially receiving a portion of another carton.

3. The carton of claim 2, wherein the at least one locking flap is a first locking flap foldably connected to the first side panel and the locking features further comprise a second locking flap foldably connected to the second side panel.

4. The carton of claim 1, wherein each of the first top end flap and the second top end flap comprises a base portion, the handle portion is a first handle portion foldably connected to the base portion of the first top end flap, and the second top end flap comprises a second handle portion foldably connected to the base portion of the second top end flap.

5. The carton of claim 4, wherein each of the first top end flap and the second top end flap comprises a handle opening disposed in a portion of at least one of the respective base portion and the handle portion.

6. The carton of claim 4, wherein, in the first configuration of the closed top portion, the first top end flap and the second top end flap are in overlapping, generally planar relation.

7. The carton of claim 6, wherein, in the first configuration of the closed top portion, each of the third top end flap and the fourth top end flap is in a generally upright configuration and a receiving space is defined between the third top end flap and the fourth top end flap.

8. The carton of claim 7, wherein, in the second configuration of the closed top portion, the respective base portions are obliquely disposed relative to each another and the respective handle portions are in at least partial face-to-face contact.

9. The carton of claim 8, wherein the at least one handle tab is a pair of handle tabs, each of the first top end flap and the second top end flap comprises the respective pair of handle tabs, and each of the third top end flap and the fourth top end flap comprises the respective aperture, and wherein, in the second configuration of the closed top portion, each handle tab is at least partially inserted through the respective aperture.

10. The carton of claim 1, wherein the plurality of panels further comprises a bottom panel, the bottom panel is foldably connected to each of the front panel, the back panel, the first side panel, and the second side panel.

11. The carton of claim 10, further comprising a plurality of gussets, the plurality of gussets comprising a first gusset foldably connected to each of the front panel and the first side panel, a second gusset foldably connected to each of the first side panel and the back panel, a third gusset foldably connected to each of the back panel and the second side panel, and a fourth gusset foldably connected to each of the second side panel and the front panel.

12. The carton of 11, wherein the plurality of panels and the plurality of gussets provide a substantially continuous surface that at least partially forms a bottom receptacle of the carton.

13. The carton of claim 1, wherein the plurality of end flaps further comprises a plurality of bottom end flaps foldably connected to respective panels of the plurality of panels.

14. The carton of claim 13, wherein the plurality of bottom end flaps at least partially overlap to form a closed bottom of the carton.

15. The carton of claim 14, wherein at least one bottom end flap of the plurality of bottom end flaps comprises a proximal section foldably connected to a distal section, the distal section positioned in a generally upright position in the interior of the carton to form a plurality of interior sections.

16. A blank for forming a carton for holding one or more articles, the blank comprising:

a plurality of panels for extending at least partially around an interior of the carton formed from the blank, the plurality of panels comprising a front panel, a back panel, a first side panel, and a second side panel;

a plurality of end flaps foldably connected to respective panels of the plurality of panels, the plurality of end flaps is for forming a closed top portion of the carton that is reconfigurable between a first configuration having a substantially flat profile and a second configuration forming a handle of the carton formed from the blank, the plurality of end flaps comprising a first top end flap foldably connected to the front panel, a second top end flap foldably connected to the back panel, a third top end flap foldably connected to the first side panel at a first fold line, and a fourth top end flap foldably connected to the second side panel at a second fold line, at least one of the first top end flap and the second top end flap comprising at least one handle tab and a handle portion comprising a top edge of the at least one of the first top end flap and the second top end flap, at least one of the third top end flap and the fourth top end flap comprising an aperture for at least partially receiving the at least one handle tab when the carton is formed from the blank, the handle portion forms the handle of the carton formed from the blank; and locking features for engaging at least one other carton when the carton is formed from the blank, the locking features comprise a first locking tab foldably connected to the third top end flap at third fold line and a second locking tab foldably connected to the fourth top end flap at a fourth fold line, the first locking tab is spaced away from the first side panel and the second locking tab is spaced away from the second side panel such that the third fold line is spaced away from the first fold line and such that the fourth fold line is spaced away from the second fold line, each of the first locking tab and the second locking tab has a respective pair of flange portions and a respective pair of notches between the respective flange portions and the respective third end flap and fourth top end flap, each of the first locking tab and the second locking tab is for extending above the top edge of the at least one of the first top end flap and the second top end flap when the closed top portion of the carton formed from the blank is in the second configuration.

17. The blank of claim 16, wherein the locking features further comprise at least one locking flap foldably connected to at least one panel of the plurality of panels, the at least one locking flap is at least partially separable from the at least one panel of the plurality of panels for forming an opening for at least partially receiving a portion of another carton when the carton is formed from the blank.

18. The blank of claim 17, wherein the at least one locking flap is a first locking flap foldably connected to the first side panel and the locking features further comprise a second locking flap foldably connected to the second side panel.

19. The blank of claim 16, wherein each of the first top end flap and the second top end flap comprises a base portion, the handle portion is a first handle portion foldably connected to the base portion of the first top end flap, and the second top end flap further comprises a second handle portion foldably connected to the base portion of the second top end flap.

20. The blank of claim 19, wherein each of the first top end flap and the second top end flap comprises a handle opening disposed in a portion of at least one of the respective base portion and the respective handle portion.

21. The blank of claim 19, wherein, in the first configuration of the closed top portion of the carton formed from the blank, the first top end flap and the second top end flap are in overlapping, generally planar relation.

22. The blank of claim 21, wherein, in the first configuration of the closed top portion of the carton formed from the blank, each of the third top end flap and the fourth top end flap is in a generally upright configuration and a receiving space is defined between the third top end flap and the fourth top end flap.

23. The blank of claim 22, wherein the at least one handle tab is a pair of handle tabs, each of the first top end flap and the second top end flap comprises the respective pair of handle tabs and each of the third top end flap and the fourth top end flap comprises the respective aperture, and wherein, in the second configuration of the closed top portion of the carton formed from the blank, each handle tab is at least partially inserted through the respective aperture.

24. The blank of claim 16, wherein the plurality of panels further comprises a bottom panel, the bottom panel foldably connected to each of the front panel, the back panel, the first side panel, and the second side panel.

25. The blank of claim 24, further comprising a plurality of gussets, the plurality of gussets comprising a first gusset foldably connected to each of the front panel and the first side panel, a second gusset foldably connected to each of the first side panel and the back panel, a third gusset foldably connected to each of the back panel and the second side panel, and a fourth gusset foldably connected to each of the second side panel and the front panel.

26. The blank of 25, wherein the plurality of panels and the plurality of gussets provide a substantially continuous surface that at least partially forms a bottom receptacle of the carton formed from the blank.

27. The blank of claim 16, wherein the plurality of end flaps further comprises a plurality of bottom end flaps foldably connected to respective panels of the plurality of panels.

28. The blank of claim 27, wherein at least one bottom end flap of the plurality of bottom end flaps comprises a proximal section foldably connected to a distal section, the distal section is for being positioned in a generally upright position in the interior of the carton formed from the blank to form a plurality of interior sections.

29. A method of forming a carton for holding one or more articles, the method comprising:

obtaining a blank comprising a plurality of panels comprising a front panel, a back panel, a first side panel, and a second side panel, the blank further comprising a plurality of end flaps foldably connected to respective panels of the plurality of panels, the plurality of end flaps comprising a first top end flap foldably connected to the front panel, a second top end flap foldably connected to the back panel, a third top end flap foldably connected to the first side panel at a first fold line, and a fourth top end flap foldably connected to the second side panel at a second fold line, at least one of the first top end flap and the second top end flap comprising at least one handle tab and a handle portion comprising a top edge of the at least one of the first top end flap and the second top end flap, at least one of the third top end flap and the fourth top end flap comprising an aperture for at least partially receiving the at least one handle tab, the blank further comprising locking features for engaging at least one other carton, the locking features comprise a first locking tab foldably connected to the third top end flap at a third fold line and a fourth locking tab foldably connected to the fourth top end flap at a fourth fold line, the first locking tab is spaced away from the first side panel and the second locking tab is spaced away from the second side panel such that the third fold line is spaced away from the first fold line and such that the fourth fold line is spaced away from the second fold line, each off the first locking tab and the second locking tab has a respective pair of flange portions and a respective pair of notches between the respective flange portions and the respective third end flap and fourth top end flap;

folding the plurality of panels at least partially around an interior of the carton; and folding the plurality of end flaps to form a closed top portion, the closed top portion of the carton is reconfigurable between a first configuration having a substantially flat profile and a second configuration in which the handle portion forms a handle of the carton, each of the first locking tab and the second locking tab extends above the top edge of the at least one of the first top end flap and the second top end flap when the closed top portion of the carton is in the second configuration.

30. The method of claim 29, wherein the locking features further comprise at least one locking flap foldably connected to at least one panel of the plurality of panels, the at least one locking flap is at least partially separable from the at least one panel of the plurality of panels for forming an opening for at least partially receiving a portion of another carton.

31. The method of claim 30, wherein the at least one locking flap is a first locking flap foldably connected to the first side panel and the locking features further comprise a second locking flap foldably connected to the second side panel.

32. The method of claim 29, wherein each of the first top end flap and the second top end flap comprises a base portion, the handle portion is a first handle portion foldably connected to the base portion of the first top end flap and the second top end flap further comprises a second handle portion foldably connected to the base portion of the second top end flap.

33. The method of claim 32, wherein each of the first top end flap and the second top end flap comprises a handle opening disposed in a portion of at least one of the respective base portion and the respective handle portion.

34. The method of claim 32, wherein, in the first configuration of the closed top portion, the first top end flap and the second top end flap are in overlapping, generally planar relation.

35. The method of claim 34, wherein, in the first configuration of the closed top portion, each of the third top end flap and the fourth top end flap is in a generally upright configuration and a receiving space is defined between the third top end flap and the fourth top end flap.

36. The method of claim 35, wherein, in the second configuration of the closed top portion, the base portions are obliquely disposed relative to each another and the handle portions are in at least partial face-to-face contact.

37. The method of claim 36, wherein the at least one handle tab is a pair of handle tabs, each of the first top end flap and the second top end flap comprises the respective pair of handle tabs and each of the third top end flap and the fourth top end flap comprises the respective aperture, and wherein, in the second configuration of the closed top portion, each handle tab is at least partially inserted through a respective aperture.

38. The method of claim 29, wherein the plurality of panels further comprises a bottom panel, the bottom panel foldably connected to each of the front panel, the back panel, the first side panel, and the second side panel.

39. The method of claim 29, further comprising a plurality of gussets, the plurality of gussets comprising a first gusset foldably connected to each of the front panel and the first side panel, a second gusset foldably connected to each of the first side panel and the back panel, a third gusset foldably connected to each of the back panel and the second side panel, and a fourth gusset foldably connected to each of the second side panel and the front panel.

40. The method of 39, wherein the plurality of panels and the plurality of gussets provide a substantially continuous surface that at least partially forms a bottom receptacle of the carton.

41. The method of claim 29, wherein the plurality of end flaps further comprises a plurality of bottom end flaps foldably connected to respective panels of the plurality of panels.

42. The method of claim 41, wherein the plurality of bottom end flaps at least partially overlap to form a closed bottom of the carton.

43. The method of claim 42, wherein at least one bottom end flap of the plurality of bottom end flaps comprises a proximal section foldably connected to a distal section, the distal section positioned in a generally upright position in the interior of the carton to form a plurality of interior sections.

44. A system, comprising:

a first carton for holding one or more articles, the first carton comprising:

a plurality of panels extending at least partially around an interior of the first carton, the plurality of panels comprising a front panel, a back panel, and at least one side panel;

a plurality of end flaps foldably connected to respective panels of the plurality of panels and forming a closed top portion of the first carton, the closed top portion of the first carton has a substantially flat profile and defines a receiving space; and a second carton for holding one or more articles, the second carton positioned in the receiving space of the first carton and secured to the first carton, the second carton comprising:

a plurality of panels extending at least partially around an interior of the second carton, the plurality of panels comprising a front panel, a back panel, a first side panel, and a second side panel;

a plurality of end flaps foldably connected to respective panels of the plurality of panels and forming a closed top portion of the second carton, the plurality of end flaps of the second carton comprising a first top end flap foldably connected to the front panel, a second top end flap foldably connected to the back panel, a third top end flap foldably connected to the first side panel at a first fold line, and a fourth top end flap foldably connected to the second side panel at a second fold line, at least one of the first top end flap and the second top end flap comprising at least one handle tab and a handle portion comprising a top edge of the at least one of the first top end flap and the second top end flap, at least one of the third top end flap and the fourth top end flap comprising an aperture for at least partially receiving the at least one handle tab, the handle portion forms a handle of the second carton; and locking features for engaging at least one other carton, the locking features comprise a first locking tab foldably connected to the third top end flap at a third fold line and a second locking tab foldably connected to the fourth top end flap at a fourth fold line, the first locking tab is spaced away from the first side panel and the second locking tab is spaced away from the second side panel such that the third fold line is spaced away from the first fold line and such that the fourth fold line is spaced away from the second fold line, each of the first locking tab and the second locking tab has a respective pair of flange portions and a respective pair of notches between the respective flange portions and the respective third end flap and fourth top end flap of the second carton, each of the first locking tab and the second locking tab extends above the top edge of the at least one of the first top end flap and the second top end flap of the second carton.

45. The system of claim 44, wherein the first carton comprises locking features to secure the second carton to the first carton.

46. The system of claim 45, wherein the locking features of the first carton comprise at least one locking tab foldably connected to at least one end flap of the plurality of end flaps of the first carton.

47. The system of claim 46, wherein the locking features of the second carton comprise at least one locking flap foldably connected to at least one panel of the plurality of panels of the second carton, the at least one locking tab of the first carton is at least partially inserted into an opening between the at least one locking flap of the first carton and a respective panel of the first carton.

48. The system of claim 47, wherein the at least one locking flap of the second carton is a first locking flap foldably connected to the first side panel of the second carton and the locking features of the second carton further comprise a second locking flap foldably connected to the second side panel of the second carton.

49. The system of claim 48, wherein the at least one end flap of the first carton is a first top end flap and the plurality of end flaps of the first carton further comprises a second top end flap, wherein the at least one locking tab of the first carton is a first locking tab foldably connected to the first top end flap of the first carton, and wherein the locking features of the first carton further comprise a second locking tab foldably connected to the second top end flap of the first carton.

50. The system of claim 49, wherein the receiving space is defined between the first top end flap of the first carton and the second top end flap of the first carton.

51. The system of claim 44, wherein each of the first top end flap and the second top end flap of the second carton comprises a base portion, the handle portion is a first handle portion foldably connected to the base portion of the first top end flap of the second carton and the second top end flap of the second carton further comprises a second handle portion foldably connected to the base portion of the second top end flap of the second carton.

52. The system of claim 51, wherein the respective base portions of the second carton are obliquely disposed relative to each another and the respective handle portions of the second carton are in at least partial face-to-face contact.

53. The system of claim 52, wherein each of the third top end flap and the fourth top end flap of the second carton comprises the respective aperture, wherein the at least one handle tab is a pair of handle tabs, each of the first top end flap and the second top end flap of the second carton comprises the respective pair of handle tabs, and wherein each handle tab is at least partially inserted through a respective aperture.

* * * * *